US010082144B2

(12) United States Patent
Sitti et al.

(10) Patent No.: US 10,082,144 B2
(45) Date of Patent: Sep. 25, 2018

(54) REMOTELY ADDRESSABLE MAGNETIC COMPOSITE MICRO-ACTUATORS

(71) Applicant: CARNEGIE MELLON UNIVERSITY, a Pennsylvania Non-Profit Corporation, Pittsburgh, PA (US)

(72) Inventors: Metin Sitti, Pittsburgh, PA (US); Eric Diller, Toronto (CA); Shuhei Miyashita, Boston, MA (US)

(73) Assignee: Carnegie Mellon University, Pittsburgh, PA (US)

( * ) Notice: Subject to any disclaimer, the term of this patent is extended or adjusted under 35 U.S.C. 154(b) by 0 days.

(21) Appl. No.: 15/018,008

(22) Filed: Feb. 8, 2016

(65) Prior Publication Data

US 2016/0298630 A1 Oct. 13, 2016

Related U.S. Application Data

(62) Division of application No. 14/180,427, filed on Feb. 14, 2014, now Pat. No. 9,281,112.

(60) Provisional application No. 61/850,417, filed on Feb. 14, 2013.

(51) Int. Cl.

| | |
|---|---|
| ***H01F 13/00*** | (2006.01) |
| ***F04D 13/02*** | (2006.01) |
| ***H01F 7/02*** | (2006.01) |
| ***F04D 1/00*** | (2006.01) |
| ***F04D 15/00*** | (2006.01) |
| ***F04D 29/02*** | (2006.01) |
| ***F04D 29/18*** | (2006.01) |
| ***F04D 29/42*** | (2006.01) |

(52) U.S. Cl.

CPC ..... *F04D 13/027* (2013.01); *F04D 1/00* (2013.01); *F04D 15/0066* (2013.01); *F04D 29/02* (2013.01); *F04D 29/18* (2013.01); *F04D 29/426* (2013.01); *H01F 7/0242* (2013.01); *H01F 13/003* (2013.01)

(58) Field of Classification Search

CPC ..... F04D 1/00; F04D 13/027; H01F 7/0242; H01F 13/003; H01F 13/00; H01F 13/006; B01L 3/5027; B01L 3/502715

USPC ..... 422/505

See application file for complete search history.

(56) References Cited

U.S. PATENT DOCUMENTS

2004/0251770 A1* 12/2004 Ito ..... G02B 21/32 310/300

2011/0052393 A1* 3/2011 Ogrin ..... A61B 1/00156 416/1

* cited by examiner

*Primary Examiner* — Dominick L Plakkoottam
*Assistant Examiner* — Philip Stimpert
(74) *Attorney, Agent, or Firm* — Michael G. Monyok; David G. Oberdick

(57) ABSTRACT

The present invention describes methods to fabricate actuators that can be remotely controlled in an addressable manner, and methods to provide remote control such micro-actuators. The actuators are composites of two permanent magnet materials, one of which is has high coercivity, and the other of which switches magnetization direction by applied fields. By switching the second material's magnetization direction, the two magnets either work together or cancel each other, resulting in distinct "on" and "off" behavior of the devices. The device can be switched "on" or "off" remotely using a field pulse of short duration.

2 Claims, 22 Drawing Sheets effect of initial angle disabled
oblique magnetization
no effect (enabled)
$\theta_i$
$H_{pulse}$ magnetization angle after pulse
$\phi$ no effect
oblique magnetization disabled
enabled
disabled
simulation
magnetization angle $\phi$ (deg)
angle $\theta_i$ with $H_{pulse}$ (deg)
0
5
10
15
20
25
30
35
0
30
60
90
120
150
180

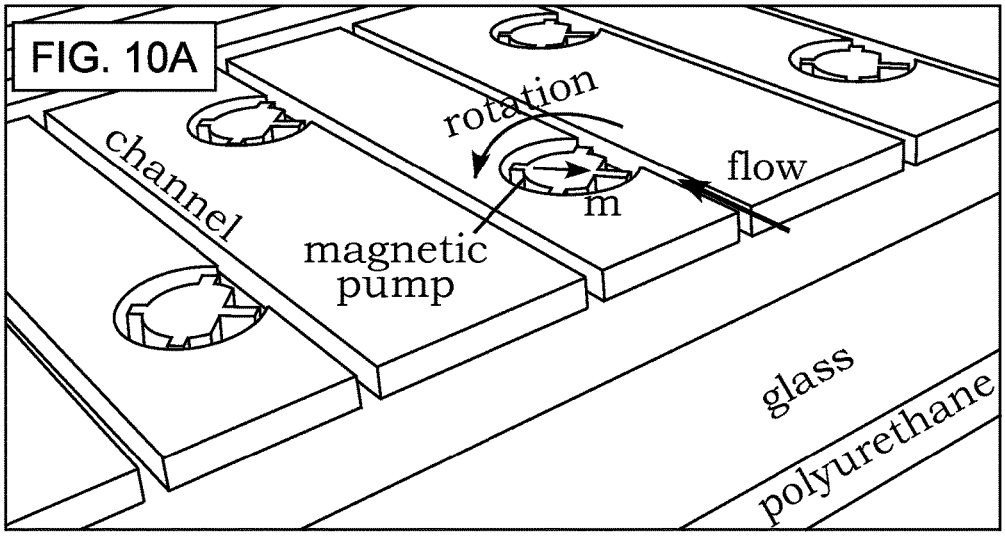
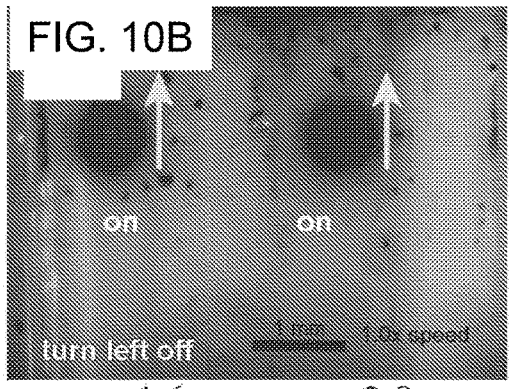
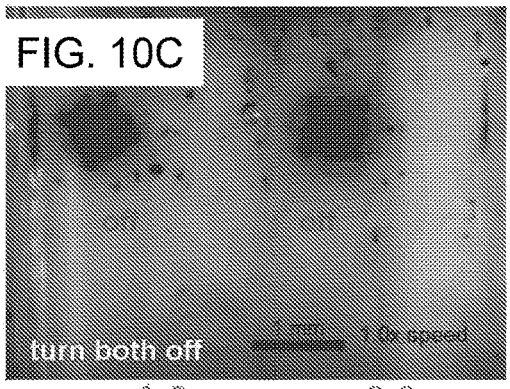
q = 4.6 q = 3.8 q = 0.0 q = 0.0
x $10^{-4}$ ml $min^{-1}$
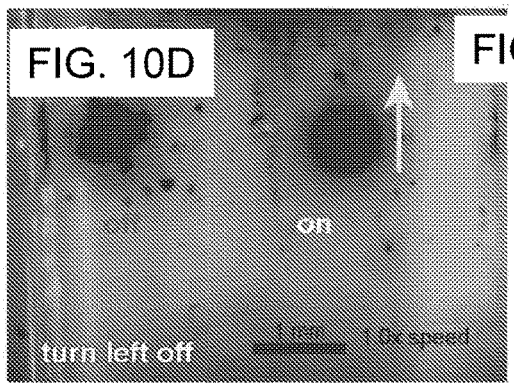
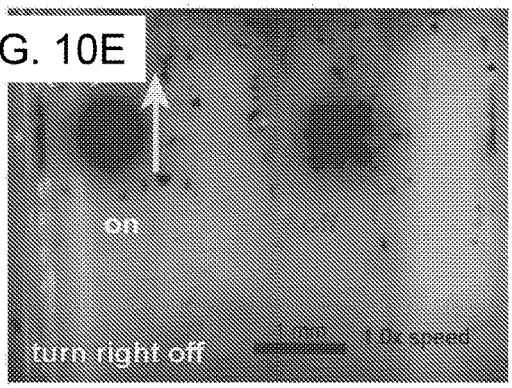
q = 0.0 q = 2.3 q = 4.5 q = -0.1
x $10^{-4}$ ml $min^{-1}$ 22
24
mobility magnet
30
33
31
32
23
29 gripping jaws
26
gripping magnets
27
28

Torque
H field

500 µm 34
31
42
38
46
40
44
24
32
36
28
permanent (NdFeB)
switchable (ferrite)

H field pulse
Net

500 µm camera
workspace
coils

Magnetization
$M_s$
0
$-M_s$
NdFeB
ferrite
-1200
0
1200
H (kA/m)

1 mm

0:00
22
1 mm

0:40

5:31

13:08

27:52 rotation rate (Hz)
field rotation rate (Hz)
0
5
10

0:00

2:16

3:17

6:59

16:25

34:23

44:35

48:19

98:17
1 mm 1 mm 0.00
34
34

1.00

2:28
pick up

4:08
pick up

4:44

6:00
release

6:53

9:02
release
1 mm

REMOTELY ADDRESSABLE MAGNETIC COMPOSITE MICRO-ACTUATORS

CROSS-REFERENCE TO RELATED APPLICATIONS

This application is a Divisional Application of U.S. application Ser. No. 14/180,427, entitled "Remotely Addressable Magnetic Composite Micro-Actuators" and filed on Feb. 14, 2014, which claims priority to Provisional Application Ser. No. 61/850,417, entitled "WIRELESSLY ADDRESSABLE MAGNETIC COMPOSITE MICRO-ACTUATORS" filed Feb. 14, 2013, all of which are incorporated herein by reference.

FIELD OF THE INVENTION

This invention relates to the field of magnetic actuators, and in particular to micro-actuators.

BACKGROUND OF THE INVENTION

Recent works in micro-scale magnetic actuation have enabled the creation of micron-scale permanent magnets for the application of forces and torques via externally-generated magnetic fields for micro-fluidic pumps and mixers, mobile micro-robots and other micro-devices. The ability to remotely and repeatedly turn "on" and "off" magnetic micro devices is an unsolved problem in the field, which could be used, for example to address devices that cannot directly contacted, or to individually address multiple devices which share the same workspace in enclosed environments, such as in micro-fluidic channels in lab-on-a-chip devices or in medical devices such as capsule endoscopes where remote actuation of numerous actuators is desired.

BRIEF SUMMARY OF THE INVENTION

The present invention describes methods to fabricate micro-actuators that can be remotely controlled in an addressable manner, and methods to provide remote control of such micro-actuators. The micro-actuators are composites of two permanent magnet materials, one of which is has high coercivity, and the other of which switches magnetization direction by applied fields. By switching the second material's magnetization direction, the two magnets either work together or cancel each other, resulting in distinct "on" and "off" behavior of the devices. The device can be switched "on" or "off" remotely using a field pulse of short duration. Because the switching field pulse covers the entire workspace, this method could be used to selectively disable and enable many micro-devices concurrently based on their orientations. Orientation control is achieved by a multi-step process using a field gradient to select a device for disabling by controlling each device's orientation. In one embodiment of the present invention, the micro-actuators can be used as micro-pumps, or as an array of micro-pumps.

Another embodiment of the present invention is a method of remote addressable magnetic actuation for sub-mm microrobotics which uses the magnetic hysteresis characteristics of multiple magnetic materials to achieve advanced state control of many magnetic actuators sharing a workspace. The present invention simultaneously uses multiple magnetic materials with varying magnetic hysteresis characteristics to effectively gain multiple control inputs as different applied magnetic field strengths. In this way, the present invention addresses the magnetic state of multiple magnets which share the same workspace, or control the magnetic state of a single microrobotic element to increase the level of control. This concept effectively increases the number of magnetic control inputs beyond one. The present invention provides multiple magnetic control inputs applicable in various areas of milli- or microrobotics to address multiple magnetic elements for motion or actuation.

Further, the present invention can be robot design specific, i.e. they typically take advantage of a microrobot specific dynamic response which is not applicable to other microrobotic platforms. Thus, the ability to independently address multiple generic magnetic devices which share the same workspace in enclosed environments, such as in microfluidic channels or even the human body, is an unsolved challenge. The present invention method can remotely change the state, in effect reversing or even turning "off", of micromagnetic actuators in an addressable manner. In addition, the present invention method is general in nature and can be applied to nearly any microrobotic system that is actuated by remotely-applied magnetic fields, at the microscale or larger. In one form, the present invention method also has the capability to scale for the independent addressing of a large number of microrobotic elements. The present invention provides for the use of multiple magnetic materials with varying magnetic hysteresis characteristics in tandem to achieve addressable control.

The magnetization of so-called "permanent" magnet materials in fact can be reversed by applying a large field against the magnetization direction. The field required to perform this switch (i.e. the magnetic coercivity) is different for each magnetic material. For permanent magnetic materials, the coercivity field is much larger than the fields at which the microrobots are actuated for motion, allowing for motion actuation and magnetic switching to be performed independently. By using multiple materials with different magnetic coercivities, the magnetic reversal of each magnet can also be performed independently by applying magnetic fields of the correct strength. This independent magnetic switching can be used in microrobotic actuators to achieve addressable control of microrobotic elements. The present invention can include several heterogeneous (each made from a different magnetic material) micromagnet modules interacting locally via magnetic torques and forces. The present invention can selectively reverse the magnetization of one module that can change the system state from attractive to repulsive state. Whereas, a set of heterogeneous magnetic modules floating on a liquid surface can be remotely reconfigured by application of a field of varying magnitude. In such a way, the morphology of the assembly can be altered arbitrarily into a number of states using a single applied field of varying strength. This implementation could be used for shape-changing microrobots that adapt to the task at hand.

Another actuation method can include a pair of magnetic materials can work together in one actuator, forming a magnetic composite whose magnetic moment sum interacts with externally-applied or locally-induced fields. One embodiment of the present invention can be a microscale permanent magnet composite material that can be remotely and reversibly turned "off" and "on" by the application of a magnetic field pulsed along the magnetic axis which reverses the magnetization of one of the materials. For completely remote operation, the pulsed field can be supplied by electromagnetic coils outside the device workspace. When a strong current is pulsed through the coils, the magnetization of some of the permanent magnets is flipped, allowing for an "off"-on net magnetization of the set.

The magnetic composite material of the present invention can be scaled down to the micron-scale and enables remote control. The anisotropic composite is made from two materials of equal magnetic moment: one permanent magnet material of high coercivity and one material of lower coercivity relative to the permanent magnet, which switches magnetization direction by applied fields. By switching the second material's magnetization direction, the two magnets either work together or cancel each other, resulting in distinct "on" and "off" behavior of the device. The device can be switched "on" or "off" remotely using a field pulse of short duration. Because the switching field pulse covers the entire workspace, this method could be used to selectively disable and enable many microdevices concurrently based on their orientations. Orientation control is achieved by a multi-step process using a field gradient to select a device for disabling by controlling each device's orientation. The present invention method creates addressable mobile microrobots that are free to move on a 2D surface and perform a task as a team.

BRIEF DESCRIPTION OF THE DRAWINGS

The present invention is illustratively shown and described in reference to the accompanying drawings, in which:

FIGS. 10A-10E shows a rendering and frames from videos of a functioning micro-pump in micro-fluidic channels fabricated and controlled according to the present invention;

DETAILED DESCRIPTION OF THE INVENTION

Figure 1:
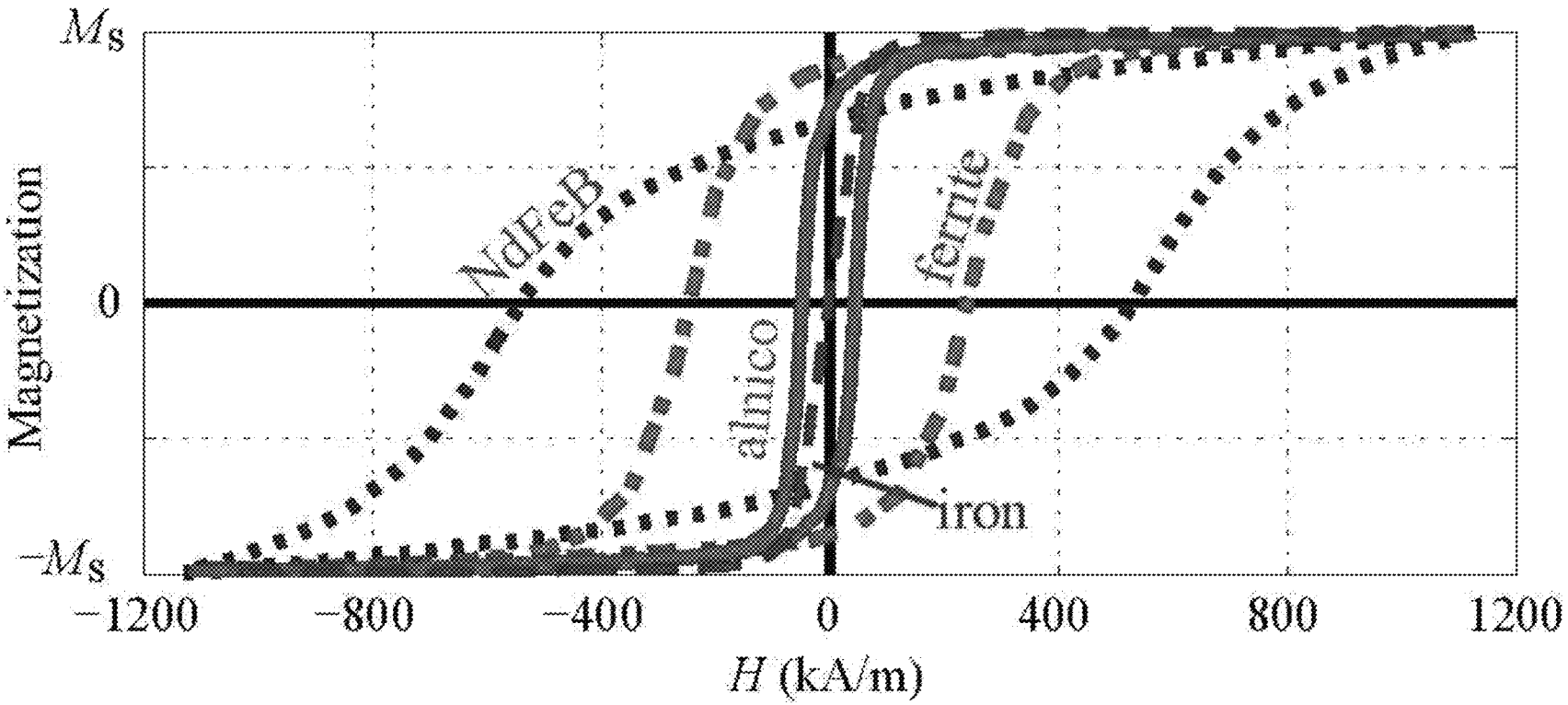
FIG. 1 is a H-m magnetic hysteresis loops of microrobot magnetic materials, taken in an alternating gradient force magnetometer for applied field up to 1110 kA $m^{-1}$ shows distinct material coercivity values for NdFeB, ferrite, alnico, and iron.

The present invention describes systems, methods and apparatuses for micro-actuators that can be remotely controlled in an addressable manner, and methods to provide remote control such micro-actuators. The micro-actuators are composites of two permanent magnet materials, one of which is has high coercivity, and the other of which switches magnetization direction by applied fields. By switching the second material's magnetization direction, the two magnets either work together or cancel each other, resulting in distinct "on" and "off" behavior of the devices. The device can be switched "on" or "off" remotely using a field pulse of short duration. As a possible alternative embodiment of the presented addressable actuation scheme, any set of magnetically-actuated micro-devices could be addressably controlled. This could be used for controlling many untethered magnetic micro-robots, micro-fluidic valves and mixers, remote mobile micro-sensors, or tools in a capsule endoscope. In the area of micro-robots, a large number of untethered micro-robots could be individually controlled for operation on a 2D surface or when suspended in fluids such as in a micro-fluidic channel or in the lumens of the human body. In the area of micro-fluidic devices, the presented concept could be applied to any magnetic micro-pump, valve, mixer or sorter which is powered by remote magnetic elements. This could allow for the simple inclusion of multiple addressable elements without the need for embedded wires or control channels, which are the current state of the art. In the area of micro-sensors, an array of independently addressable mobile elements could be dispersed as a distributed network inside a micro-fluidic channel or biological cavities. Here, the magnetic disabling could be used to move the sensor nodes or to alter the sensing modality. In the area of endoscopy, the presented disabling method could be used to disable the motion element for a remote magnetic capsule controlled by external permanent magnet. In this way, the magnetic field could be used to actuate some additional tool on the capsule without moving the capsule itself. Alternatively, the method could be used to independently address multiple magnetic tools included in one endoscope. This could be a magnetic gripper, magnetic biopsy tool, magnetically-activated drug release or other magnetic actuator. As a remote wireless addressable actuation method, this could be used both in capsule endoscopes or in traditional tethered catheters which have a limited space for control wires. The presented addressability concept could be scaled larger into the centimeterscale with no significant change in performance. With an increase in disabling system voltage, the disabling coil could be made larger and further from the workspace. This could be scaled even to the size of a human body to disabling actuators inside the body.

Embodiments of the presented concept could be used for small or micro-scale magnetic actuators operating in any type of medium. The embodiment presented here operates in a viscous liquid, but the approach is valid for operating in any liquid environment or in air or vacuum. The only limitation is that the environment must be free of magnetic materials.

One embodiment of the present invention utilizes magnetic hysteresis for magnetic state control discussed in detail below.

A. Addressable Magnetization Direction

Figure 2A:
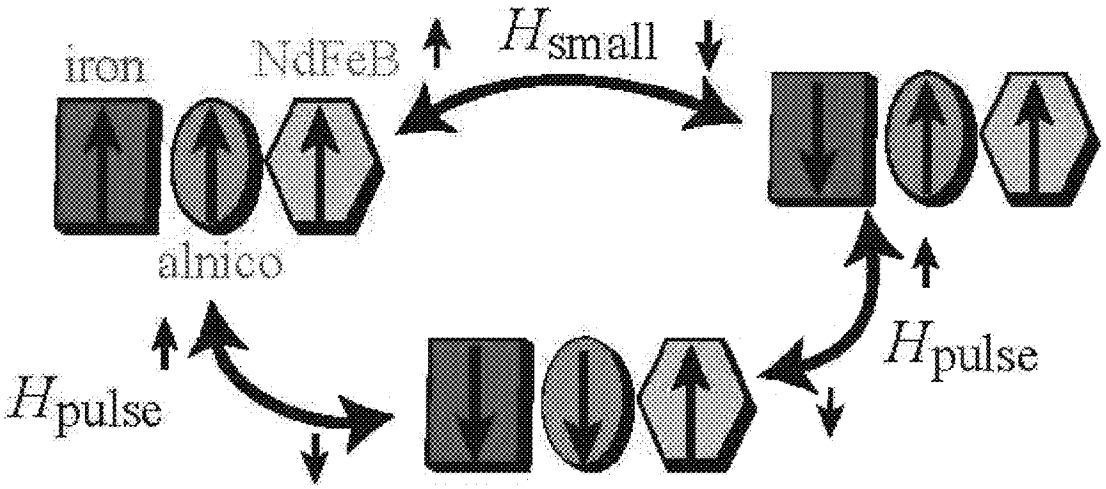
FIGS. 2A-2B are schematics showing the multiple magnetic states which can be achieved through the use of a variety of magnetic materials.

To achieve many-state magnetic control of a number of microrobotic actuators, a number of magnetic materials with different magnetic hysteresis characteristics is required. The nonzero magnetic coercivity $H_c$ describes the width of the hysteresis loop of a material, while the remanence $M_r$ describes the magnetization of the material after an applied field has been removed. The magnetic properties for a few commonly-used materials are compared in Table I. In addition, the experimentally measured magnetic hysteresis loops for NdFeB, ferrite, alnico and iron are shown in FIG. 1. These materials cover a wide range of magnetic hysteresis values, from NdFeB and SmCo, which are permanent under all but the largest applied fields, to iron, which exhibits almost no magnetic hysteresis. For comparison, the magnetic fields typically applied to actuate magnetic microactuators are up to 12 kA $m^{-1}$, which is only strong enough to remagnetize the iron. Thus, the magnetic states of SmCo, NdFeB, ferrite and alnico can be preserved when driving the actuator. This method can be used to independently control the magnetization of each material, even when the materials share the same workspace. By applying a series of pulses in the desired direction greater than the coercivity field (Hc) of each material, an independent magnetization state of each magnet material can be achieved, as shown schematically in FIG. 2(*a*) for a set of three independent micromagnetic elements, each made from a different magnetic material, the magnetization of which can be independently addressed by applying magnetic field pulses of various strengths. Here, $H_{pulse}$ is a large field pulse and $H_{small}$ is a small static field. Here, a set of three magnetic actuators made from iron, NdFeB and alnico are shown, and the magnetization direction of each actuator can be selectively switched by applying small or large magnetic fields relative to the material's coercivity.

TABLE I

MAGNETIC MATERIAL HYSTERESIS CHARACTERISTICS (* DENOTES MEASURED)

| Material | Coercivity He (kA/m) | Remanence Mr (kA/m) |
|---|---|---|
| SmCo | 3100 | ~4000 |
| NdFeB | 620* | ~2300 |
| ferrite | 320* | 110-400 |
| alnico V | 40* | 95-170 |
| iron | 0.6* | ~0 |

B. Powder Composite Magnetization Disabling

Figure 2B:
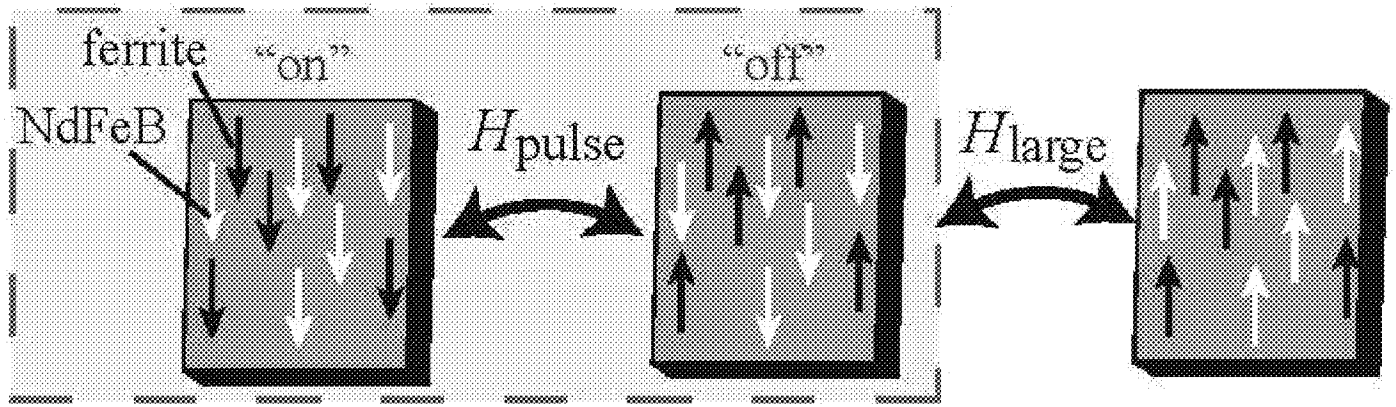

Demagnetizing a number of microrobotic actuators in an addressable manner to achieve independent control is a second magnetization method. It is difficult to demagnetize a single magnet by applying a single demagnetizing field because the slope of the magnetic hysteresis loop (i.e. the magnetic permeability) near the demagnetized state is very steep, as seen in FIG. 1. Thus, such a demagnetization process must be very precise to accurately demagnetize a magnet. While steadily decreasing AC fields can be used to effectively demagnetize a magnetic material, this method does not allow for addressable demagnetization because it will disable all magnets in the workspace. This issue is overcome by the use of a magnetic composite to enable untethered addressable magnetic disabling. A different demagnetization procedure is employed to achieve a more precise demagnetization by employing two materials, both operating near saturation where the permeability is relatively low (see FIG. 3A). In this method, shown schematically in FIG. 2(*b*) a single magnetic composite actuator where an applied switching field $H_{pulse}$ can be applied to switch only the ferrite magnetization without affecting the NdFeB magnetization. This switching allows the device to be switched between "on" and "off" states as the magnetic moments add or cancel each other. While the internal field of the magnet will not be zero, the net field outside the magnet will be nearly zero in the "off" state, resulting in near zero net magnetic actuation forces and torques. A single magnetic composite actuator can be switched between the "up", "off" or "down" states by applying pulses of different strength. By applying a very large field pulse $H_{large}$ (as shown in FIG. 2B), the NdFeB magnetization can also be switched, reversing the "forward" direction of the actuator. Thus, the use of at least one magnetic material with a nonzero magnetic coercivity results in a system which has a memory of the fields applied to it, allowing for magnetic disabling.

C. Reconfigurable Magnetic Modules

Figure 3A:
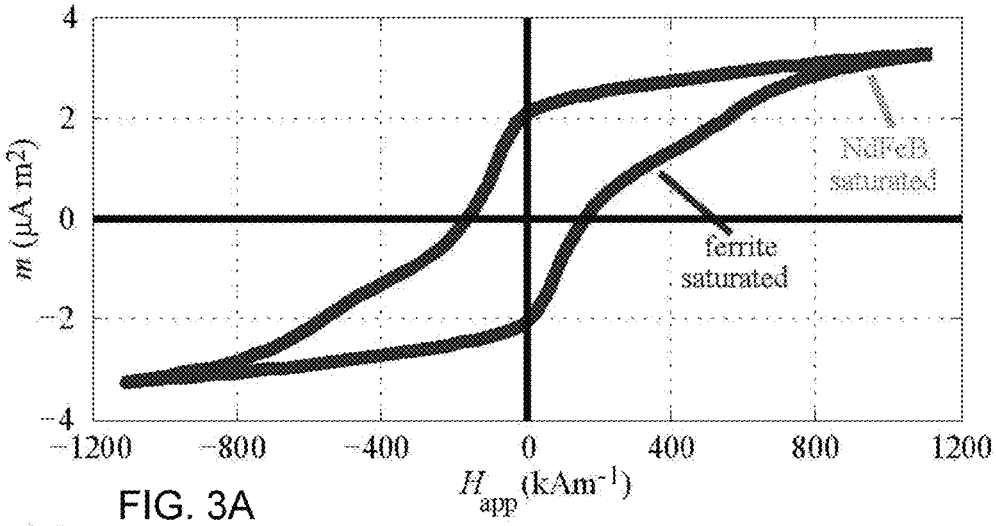
FIG. 3A shows magnetic hysteresis loops of an exemplar micro-device fabricated according to the present invention illustrating the saturation moments for ferrite and NdFeB.

The magnetization H-m loop for the reconfigurable modules are shown in FIG. 3A, as taken in an alternating gradient force magnetometer (AGFM, Princeton Measurements MicroMag 2900), with applied field strength up to 1110 kA $m^{-1}$. The modules used in experiments contain magnets made from NdFeB, alnico, and Fe, which show very distinct coercivity values. Thus, to change the magnetization of Fe, a small static 12 kA $m^{-1}$ field is applied. To change the alnico magnetization, a large field pulse of 80 kA $m^{-1}$ is applied. The NdFeB magnetization remains constant during the following experiments, but could potentially also be switched by application of an even larger field pulse.

D. Magnetic Composite

The magnetization H-m loop for the microrobot composite material is shown in FIG. 3A, with applied field up to 1110 kA $m^{-1}$. The plot shows two distinct saturation moments $m_s$ of approximately $m_{s,ferrite}$=1.5 μA $m^2$ at 300 kA $m^{-1}$ and $m_{s,ferrite}$ $m_{s,NdFeB}$=3.3 μA $m^2$ at 800 kA $m^{-1}$. The two material moments must be equal to cancel exactly when the device is turned "off". To allow this cancellation to be finely tuned, the volume ratio of the two materials is chosen such that $m_{s,NdFeB}$ is slightly larger than $m_{s,ferrite}$. The field used to magnetize the NdFeB is then adjusted in an iterative fashion to lower $m_{NdFeB}$ from its saturation value until $m_{NdFeB}$ equals $m_{s,ferrite}$.

Figure 3B:
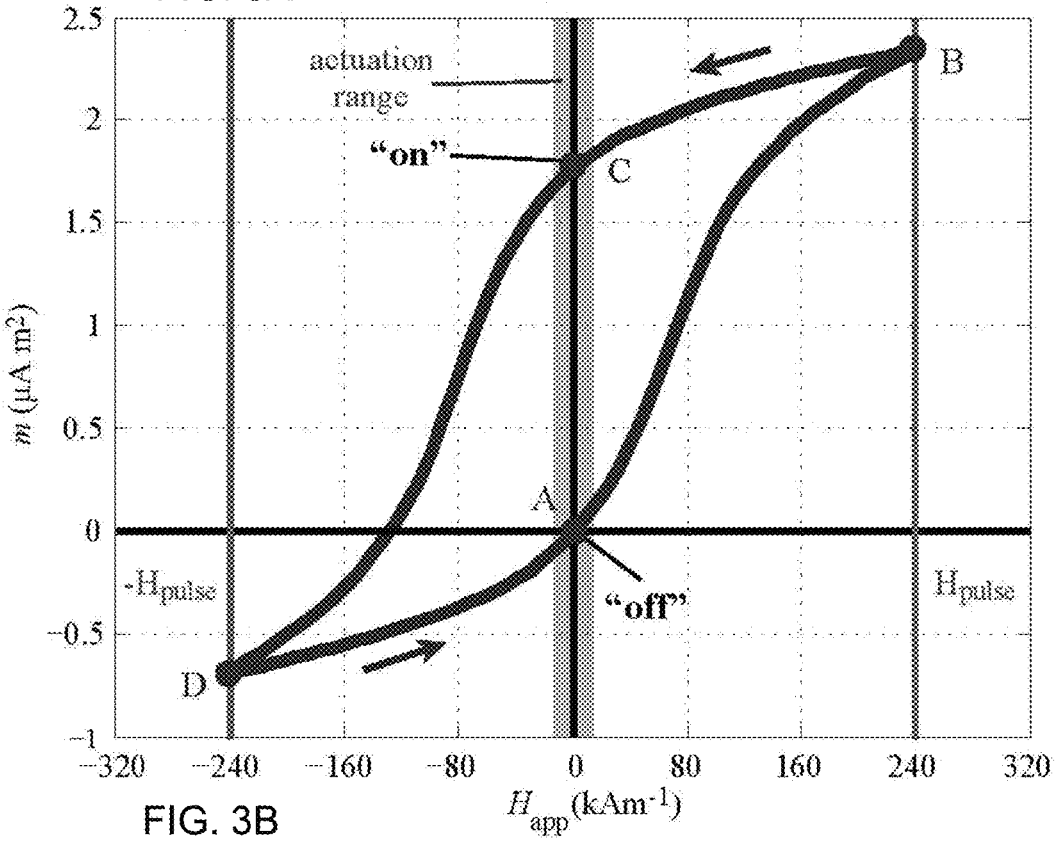
FIG. 3B shows the H-m magnetic hysteresis loop of a composite microrobot made from ferrite and NdFeB, wherein an 240 kA $m^{-1}$ field switches the ferrite magnetization while leaving the NdFeB unaffected, resulting in a vertically-biased loop intersecting the origin, showing clear "on" and "off" states.

When fields are applied below the NdFeB coercivity, the NdFeB acts as a permanent magnet, biasing the device magnetization, as shown in the H-m loop of FIG. 3B for $H_{pulse}$ up to +240 kA $m^{-1}$. Traversing the magnetic hysteresis loop, the device begins in the "off" state at point "A", where motion actuation fields, indicated by the +12 kA $m^{-1}$ range, only magnetize the device to about 0.08 μA m2, resulting in minimal motion actuation. To turn the device "on", a 240 kA $m^{-1}$ pulse is applied in the forward direction, bringing the device to point "B". After the pulse, the device returns to point "C", in the "on" state. Here, motion actuation fields vary the device moment between about 1.7 and 1.8 μA $m^2$. To turn the device "off", a pulse in the backward direction is applied, traversing point "D", and returning to the "off" state at point "A" at the conclusion of the pulse. For small motion actuation fields in the lateral direction, the device is expected to show even lower permeability in the "on" or "off" state due to the shape anisotropy induced during the molding process. Shape anisotropy is when a particle is not perfectly spherical, the demagnetizing field will not be equal for all directions, creating one or more easy axes. When disabling a device by applying a pulse in the backward direction, the alignment of the device with respect to the pulse is critical (discussed in detail below). Even a minor misalignment will result in in-plane torques which would rotate the device into alignment with the pulsed field before the device is disabled.

Fabrication of Actuators

One embodiment of the actuators are fabricated as a composite of two different magnetic powders, bound in a non-ferromagnetic matrix, for example in polyurethane (BJB Enterprise, TC-892). One of the magnetic materials has a high coercivity. In one embodiment of the present invention, this first magnetic material is Neodymium-Iron-Boron (NdFeB, Magnequench MQP-15-7), refined in a ball mill to produce particles under 10 μm in size, with measured coercivity of around 600 kA $m^{-1}$. Once magnetized, the NdFeB retains its magnetization direction and magnitude. Alternatively, another high-coercivity magnetic material such as Samarium-Cobalt could be used for this purpose.

The second magnetic material is chosen to have the characteristic of switching its magnetization direction in the presence of a magnetic field. In one embodiment of the present invention, this second magnetic material is ferrite ($BaFe_{12}O_{19}$), ground using an endmill to grains approximately 10-50 μm in size. Ferrite has a large remanence and coercivity of around 320 kA $m^{-1}$. This coercivity is larger than the device motion actuation range in our exemplar device of ±12 kA $m^{-1}$, but much smaller than the coercivity of NdFeB, allowing for the ferrite to be switched without affecting the NdFeB. Alternatively, another magnetic material with low to medium-coercivity such as alnico V, could be used for this purpose. When alnico V is used, larger magnetic structures must be used instead of grains due to the relatively large crystal structures in this material. Thus, the minimum size for the alnico V elements is about 500 μm in length. Due to the strong demagnetizing fields present in alnico V, the aspect ratio of the alnico V element must also be maintained at approximately 4:1 or larger along the magnetization direction to prevent self-demagnetization.

Both NdFeB and ferrite can be ground to micrometer size without significant change in magnetic properties. An applied switching field $H_{pulse}$ greater than the coercivity of ferrite, but less than the coercivity of NdFeB, will switch the magnetization of the ferrite. This switching allows the device to be switched between "on" and "off" states as the magnetic moments add or cancel each other.

While the internal field of the magnet will not be zero, the net field outside the magnet will be nearly zero in the "off" state, resulting in near zero net magnetic actuation forces and torques.

This type of magnetic disabling cannot be achieved with a single magnetic material. The permeability of magnetic materials is very high when the material is far from saturation, making it difficult to demagnetize a sample completely with a pulse. While steadily decreasing AC fields can be used to effectively demagnetize a magnetic material, this method does not allow for addressable demagnetization because it will disable all magnets in the workspace. Thus, the use of the magnetic composite enables untethered addressable magnetic disabling.

One production process includes the magnetic slurry of the first and second magnetic materials and the polymer is poured into a rubber mold fabricated using soft-lithography techniques. After pouring, the entire mold is placed in a strong uniform magnetic field (800 kA $m^{-1}$) to induce a preferential "forward" direction and magnetize both magnetic materials. This field orients the individual grains and causes the magnetic particles to form long chain aggregates. This orienting process results in an anisotropic increase in remnant magnetization and coercivity of about 10% in this preferential direction, when compared with a non-oriented sample.

Due to their proximity in the matrix, the magnet grains of the first and second magnetic material can potentially interact with each other via exchange coupling, as is the case of exchange spring magnets. If this were the case in the embodiments described above, the ferrite magnetization would be coupled to the NdFeB, preventing it from switching magnetically and increasing the effective coercivity of the ferrite. However, as the coercivity of ferrite is much higher than the remanence of NdFeB, exchange coupling is considered negligible. This was verified experimentally by noting that the effective observed coercivity of the ferrite is not changed when in composite form with NdFeB.

In other embodiments of the actuators, more than two magnetic materials with different coercivities (e.g. NdFeB-ferrite-alnico, NdFeB-ferrite-iron and NdFeB-alnico-iron and NdFeB-ferrite-alnico-iron composites) could be also used to enable more diverse possible magnetic properties for the actuator.

Actuators Demonstrated in a Micro-Pump

Figure 4A:
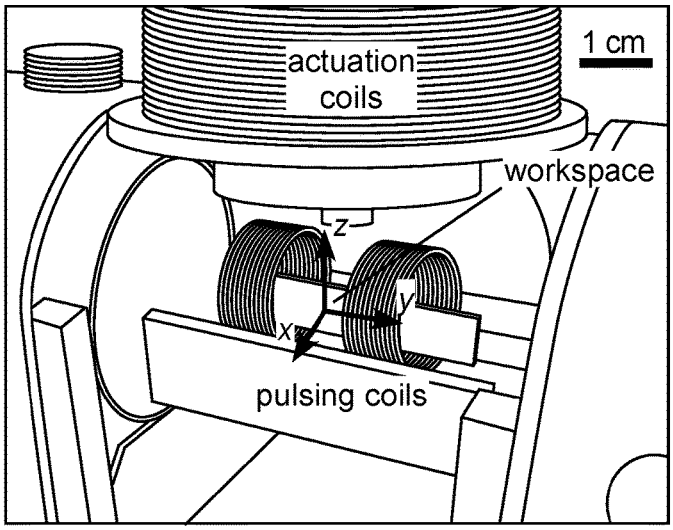
FIGS. 4A-4E shows photographs of an electromagnetic coil system as used to provide the magnetic field to control the micro-actuator of the present invention, a graph indicating the pulse of magnetic field provided by the coil in a demonstration of the present invention, and micrographs of exemplar micro-pumps fabricated according to the present invention as placed in a micro-fluidic channel.
Figure 4B:
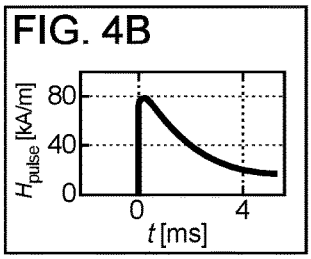
Figure 4C:
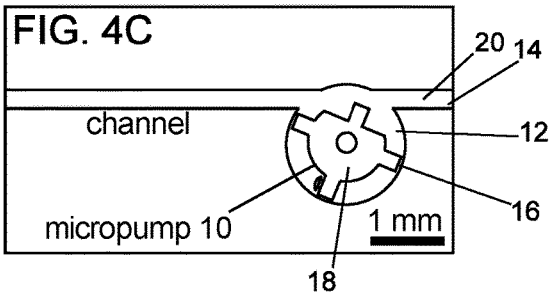
Figure 4D:
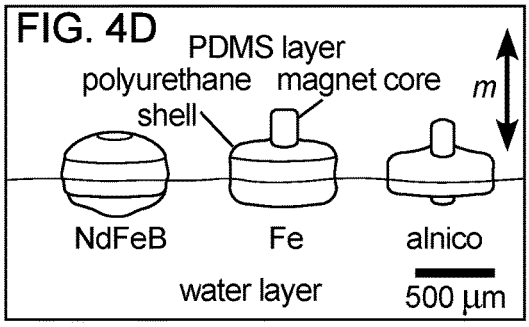
Figure 4E:
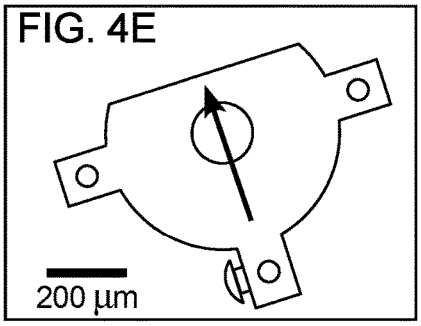

In one embodiment of the present invention shown in FIGS. 4A-E, the micro-actuators are used as micro-pumps. Without limiting the generality of the invention, further details are provided on this embodiment to explain how functional control is provided over the micro-actuators remotely. FIG. 4A is a photograph of the electromagnetic coil system used for actuation and pulsing coils surrounding the workspace. FIG. 4B is a plot of measured $H_{pulse}$ as a function of time for a 130V capacitor charge, showing a peak of 240 kA $m^{-1}$ and duration of several milliseconds. FIG. 4C is a photograph of a micropump of the present invention installed for pumping fluid in the channel. FIG. 4D is a photograph of the reconfigurable micromodules showing the two liquid layers and the module components. FIG. 4E is a photograph of the molded mobile microrobot design.

Micro-pump motion actuation is achieved by rotating magnetic fields which apply magnetic torques to drive the micro-pump. These fields, up to +12 kA $m^{-1}$ in strength, are provided in one embodiment by three air-core electromagnetic coil pairs, which can create a uniform field in any direction in the workspace, as known in the field. The coils and workspace of an exemplar configuration are shown in FIG. 4A. The currents in the electromagnetic coils are controlled, e.g. by using a PC with data acquisition system using linear electronic amplifiers (Dimension Engineering Inc., SyRen 25) and Hall-effect current sensors (Allegro Microsystems Inc., ACS714). The switching field pulse $H_{pulse}$ is created in one embodiment with a 20-turn, low-inductance (8 mH) coil of inner diameter 23 mm, placed inside the larger motion actuation coils as shown in FIG. 4A. The pulsing coil is driven by a 0.8 mF electrolytic capacitor bank in an LCR circuit, switched by silicon-controlled rectifier (Vishay, VS-70TPS12), delivering a peak current of around 450 A. The resulting $H_{pulse}$ is measured with a Hall effect sensor (Allegro 1321), and shown as a function of time in FIG. 4(*b*) for a 130V capacitor charge. The pulse lasts several milliseconds, with peak amplitude linearly proportional to the capacitor charge voltage. Because the magnetic microdevice is free to rotate, it tends to align with an applied field, which would prevent a disabling pulse from being effective. However, for a relatively fast pulse, the device inertia, fluid drag and surface friction act to keep it from aligning with the field. The approximately 100 μs $H_{pulse}$ rise-time switches the device completely before it orients to the field, as discussed below.

The workspace in this exemplar configuration is located inside both sets of coils, and contains the micro-devices of the present invention and fluid channels, where the devices rest. The fluid used in this exemplar configuration is viscous silicone oil (Dow Corning, 5-20 cSt), which eases the disabling process by increasing the viscous drag torque on the micro-pump. The microrobotic elements used in experiments are shown in FIG. 4C-E. In FIG. 4C is shown a micropump 10 disposed in a cavity or recess 12 that fluidly connects with a channel 14 containing fluid. The micropump 10 includes projections or extensions 16 from its body 18, like paddles, that extend into the flow path 20 of the fluid in the channel 16. As the micropump 10 rotates, fluid in the channel is conveyed downstream. In FIG. 4D is shown a number of free-moving magnetic modules, each containing a different magnetic material for addressable magnetic switching. These modules float at a liquid interface, and assume positions relative to each other dependent on the magnetic interaction forces between them. In FIG. 4E is shown a mobile microrobot which moves by untethered crawling motion. These microrobots are made from a magnetic composite, and can be individually addressed for motion by selectively turning off the magnetization of each microrobot. The magnetization H-m loop for the micro-pump of the exemplar configuration is shown in FIG. 3A, as taken in an alternating gradient force magnetometer (AGFM, Princeton Measurements MicroMag 2900), with applied field strength up to 1110 kA $m^{-1}$, as discussed above. The plot shows two distinct saturation moments $m_s$ of about $m_{s,ferrite}$=1.5 μA $m^2$ at 300 kA $m^{-1}$ and $m_{s,ferrite}$ $m_{s,NdFeB}$=3.3 μA $m^2$ at 800 kA $m^{-1}$. The moments of the two materials must be equal to cancel exactly when the device is turned "off". To allow the fine tuning of this cancellation, the volume ratio of the two materials is chosen so that $m_{s,NdFeB}$ is slightly larger than $m_{s,ferrite}$. The NdFeB magnetizing field is then adjusted in the AGFM in an iterative fashion to lower $m_{NdFeB}$ from its saturation value such that $m_{NdFeB}$ equals $m_{s,ferrite}$. In this case, the ratio by mass is chosen as 3.5 parts ferrite to 1 part NdFeB, although other ratios could be used with a different tuning of NdFeB magnetizing field.

As mentioned above, when fields are applied below the NdFeB coercivity, the NdFeB acts as a permanent magnet, biasing the device magnetization, as shown in the H-m loop of FIG. 3B for $H_{pulse}$ up to ±240 kA $m^{-1}$. Traversing the magnetic hysteresis loop, the device begins in the "off" state at point "A", where motion actuation fields, indicated by the ±12 kA $mm^{-1}$ range, only magnetize the device to about 0.08 μA $m^2$, resulting in minimal motion actuation. To turn the device "on", a 240 kA $m^{-1}$ pulse is applied in the forward direction, bringing the device to point "B". After the pulse, the device returns to point "C", in the "on" state. Here, motion actuation fields vary the device moment between about 1.7 and 1.8 μA $m^2$. To turn the device "off", a pulse in the backward direction is applied, traversing point "D", and returning to the "off" state at point "A" at the conclusion of the pulse. For small motion actuation fields in the lateral direction, the device is expected to show even lower permeability in the "on" or "off" state due to the shape anisotropy induced during the molding process.

Micro-Pump Alignment

When disabling a device by applying a pulse in the backward direction, the alignment of the device with respect to the pulse is critical. Even a minor misalignment will result in in-plane torques which would rotate the device into alignment with the pulsed field before the device is disabled. The torques acting on the device during this process are the applied magnetic torque, frictional drag torque and the fluid drag torque. The applied magnetic torque is $$\vec{T}_m=\mu_0\vec{m}\times\vec{H}(t), \tag{1}$$

where $\mu_0=4\pi\times10^{-7}$ H $m^{-1}$ is the permeability of free space, $\vec{m}$ is the device magnetic moment, and $\vec{H}(t)$ is the applied flux density as a function of time. As the pulse is created by a capacitor bank discharged through a coil (inductor), the applied flux density is governed by the second order LCR circuit equation $$\frac{1}{D}\frac{d^2H(t)}{dt^2}+\frac{R}{LD}\frac{dH(t)}{dt}+\frac{1}{LCD}H(t)=0, \tag{2}$$

where D is the constant relating coil current i(t) to the flux density by $H(t)=D_i(t)$ ($D\approx8{:}83$ $m^{-1}$ for the pulsing coil used), R is the circuit resistance, L is the circuit inductance and C is the capacitance. The initial condition is given by the initial charge voltage on the capacitor bank $V_0$ as $$\left.\frac{dH(t)}{dt}\right|_{t=0}=\frac{V_0}{LD}.$$

The frictional resistive drag torque from contact with the substrate is given as $$T_f = -\mu_f N \frac{d}{4}, \tag{3}$$

where $\mu_f$ is the friction coefficient, N is the normal force (device weight+adhesion), and d is the device diameter. The fluid drag torque, assuming a shear flow between the micro-pump and the surface, is given as the integral of shear stress over the micro-pump area as $$T_d = \int_A \tau_d \, dA = -\mu \frac{\pi d^2}{4} \frac{\omega}{d} \tag{4}$$

where h=5 μm is the estimated micro-pump-surface space due to surface roughness, μ is the kinematic viscosity of the liquid, and ω is the rotational rate. The total torque from eqns. (1), (3) and (4) is inserted into the single degree of freedom rotational dynamic equation $$T_m + T_f + T_d = I \frac{d^2\theta}{dt^2}(t) \tag{5}$$

$$\text{where } I \approx \frac{1}{12}\rho V\left(\frac{d}{2}\right)^2$$

is the rotational inertia about the vertical axis and θ is the in-plane rotation angle of the device. An integration of eq. (5) with initial misalignment angle $\theta_i$ for the pulse $H_{pulse}$ will determine if the device is disabled before it rotates. This result is shown along with experimental results in FIG. 5C. The simulation predicts the critical angle range for misalignment tolerance to disable to be 180±30°, where $\theta_i$=180° denotes the backward (disabling) direction. For larger misalignments (resulting in oblique magnetization), the simulation predictions are erratic due to oscillatory motion. Thus, this regime is not considered in the simulation results.

Figures 5A, 5B, 5C:
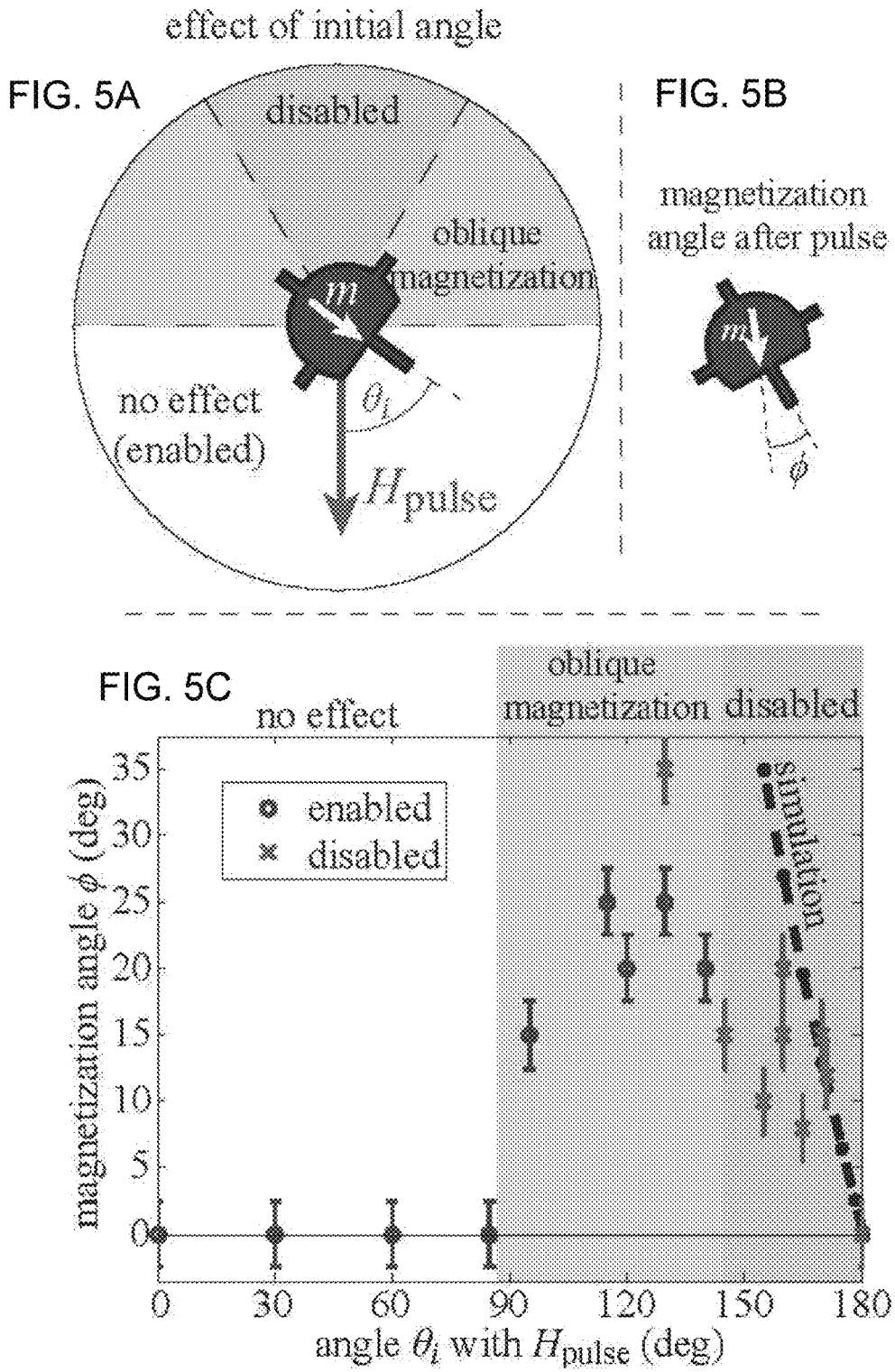
FIGS. 5A-5C show schematics of the effects of the orientation of an exemplar microdevice in relation to the pulsed magnetic field.

The critical angle range for misalignment tolerance to disable was found experimentally to be approximately 180±35°, as shown in FIG. 5A. For initial alignments within ±90° of 0° (forward pulses), the device remains magnetized in the forward direction. For moderate misalignments, the device rotates during the pulse and the resulting magnetization is not in the forward direction (and tends to be unpredictable). The angle of magnetization after the pulse φ is shown in FIG. 5B.

As seen in eq. (5), to increase the allowable disabling misalignment, the friction and drag torque can be increased by choice of geometry, material, and fluid properties, the magnetic torque can be decreased by reducing the strength of the magnetic moment m, or the pulse rise time can be shortened to magnetize the device sooner by lowering the circuit time constant λ=LC. To lower λ would require an increase in the charge voltage $V_0$.

Selective Micro-Pump Actuation

Figure 6:
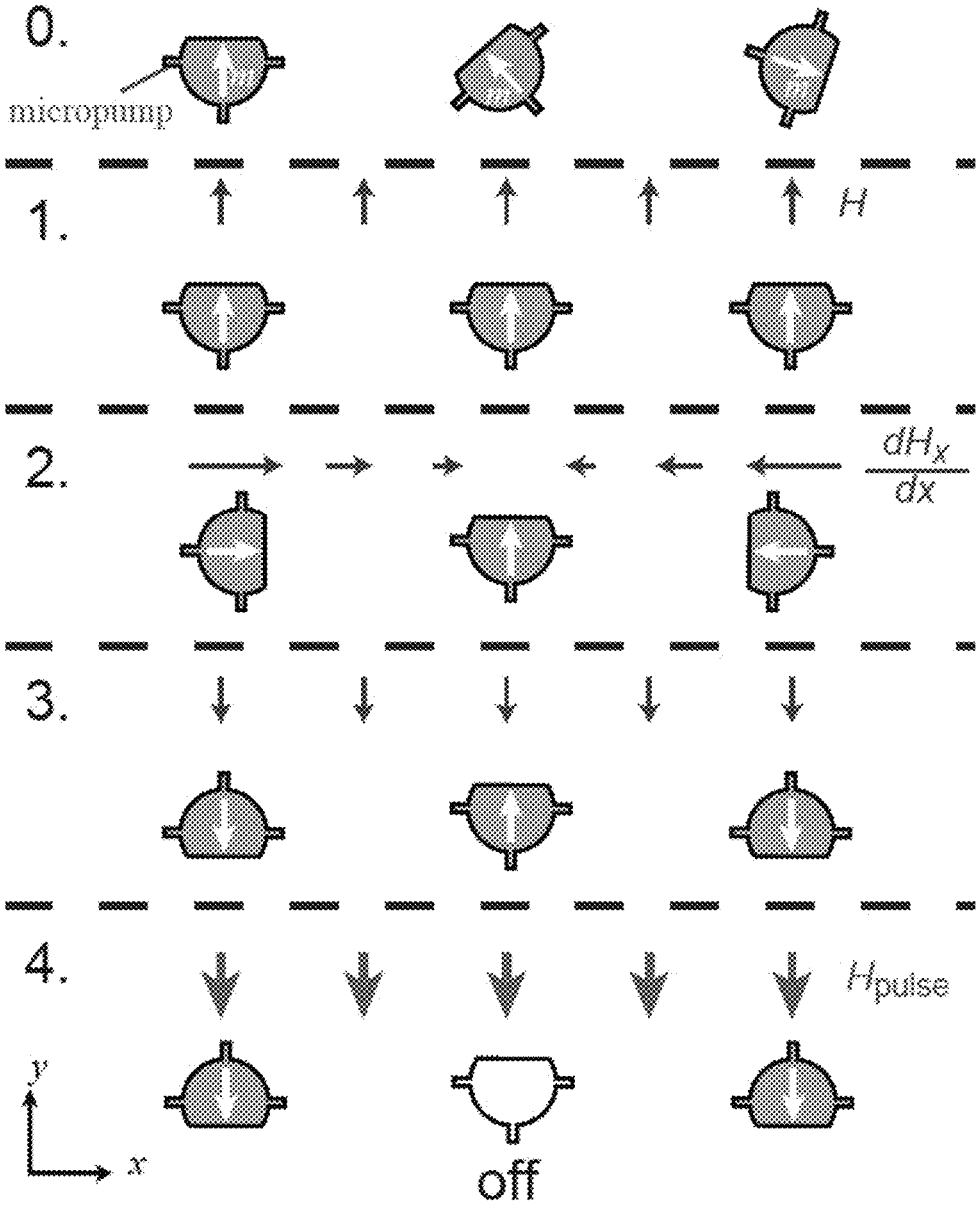
FIG. 6 shows schematics of the method to remotely orient the micro-devices according to the present invention.

The disabling method of the present invention for controlling micro-devices can be used in some embodiments to selectively disable multiple micro-pumps. Based on their orientation when the pulse is applied, each micro-pump will be enabled or disabled, as was described in the previous section. To selectively orient multiple micropumps before the switching pulse is applied, a four step method is employed, as shown in FIG. 6:

Step 0) The devices begin the process with random orientations. All devices should be in the on state to begin.

Step 1) Using a low-strength uniform field H below the devices' coercivity value, all devices are pointed in the +y-direction.

Step 2) Using two horizontal coils operated in opposition, a horizontal field gradient dHx/dx is applied. At the center of the coil system, a point of zero field exists, which is positioned over one of the microrobots. This zero-field point can be shifted to select different microrobots for disabling by adjusting the relative strength of the left and right coils Step 3) A low-strength uniform −y-directed field is applied H below the devices' coercivity value, rotating all microrobots except the selected one, which experiences no torque due to being antiparallel to the field.

Step 4) The large downward field pulse $H_{pulse}$ at or above the devices' coercivity value is applied to disable all microrobots pointing in the +y-direction. Devices pointing in the −y-direction remain "on" because their orientation $\theta_i$=0° is parallel to $H_{pulse}$.

Step 5) To selectively disable more actuators one-at-a-time, the process is repeated to target a new actuator. All previously-disabled actuators will remain pointing in the +y-direction during the process because their net magnetic moment is zero. The devices already disabled will likewise not be affected by subsequent pulses.

Addressable Micro-Gripper Actuation

Figure 21:
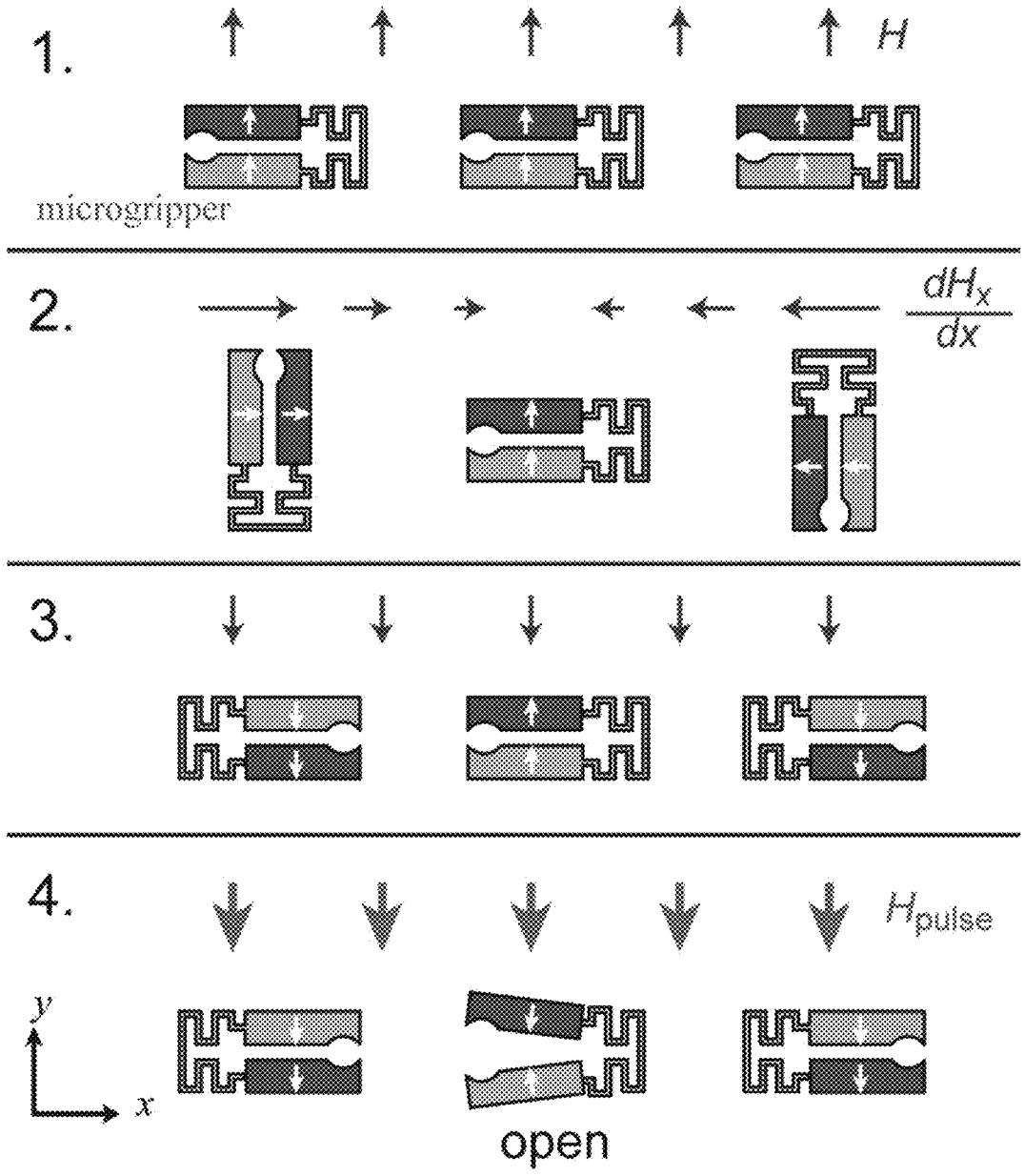
FIG. 21 is a selective orientation process to achieve addressable opening and closing of individual micro-grippers among a set. Gripper tip magnetization is shown as arrows. Dark sections indicate permanent NdFeB magnet materials, while light sections indicate switchable ferrite material.

Multiple force-based grippers can be independently opened and closed through magnetic pulses, as was shown in FIG. 21 for two grippers conducting a cargo transport demonstration. Such parallel actuation and gripping could offer significant increases in the throughput of a mobile micro-robotic gripper system for moving cargo or assembling micro-objects in increasingly complex assemblies. Due to the biased nature of the force-based micro-gripper design, the open/closed state of each micro-gripper after a field pulse is dependent on its orientation during the pulse. Thus, to open or close just a single gripper in a set, it must be pointing in a different direction from the others prior to the pulse application. Selective orientation of grippers is conducted using magnetic fields and field spatial gradients, as shown in FIG. 21. To achieve this selectively orientation without experiencing any translational motion before the switching pulse is applied, a four step method is employed:

0. The devices begin the process with random orientations. All devices should be in the on state to begin.

1. Using a uniform field H below the devices' coercivity value, all devices are pointed in the +y-direction.

2. Using two horizontal coils operated in opposition, a horizontal field gradient $dH_x/dx$ is applied. At the center of the coil system, a point of zero field exists, which is positioned over one of the micro-grippers. This zero-field point can be shifted to select a different micro-gripper for opening.

3. A uniform −y-directed field H below the devices' coercivity value is applied, rotating all micro-grippers except the selected one, which experiences no torque due to being antiparallel to the field.

4. The downward field pulse $H_{pulse}$ at or above the devices' coercivity value is applied to open all micro-grippers pointing in the +y-direction by remagnetizing the arm. Devices pointing in the −y direction remain closed because their orientation is parallel to $H_{pulse}$.

5. To selectively open more actuators one-at-a-time, the process is repeated to target a new actuator. All previously-opened actuators will remain pointing in the +y-direction during the process because their net magnetic moment is small. The grippers already opened will likewise not be affected by subsequent pulses.

Thus, a large number of micro-devices can be independently addressed by magnetic disabling if they are adequately spaced in a single direction. The minimum horizontal spacing $s_{min}$ will depend on the magnitude of the magnetic gradient field created and the minimum torque $T_{min}$ required to orient the micro-devices in step 2 above. Using eq. (6), this minimum spacing can be derived as:

$$S_{min} = \frac{T_{min}}{\mu_0 m \frac{dH_x}{dx}}. \quad (6)$$

Multiple pumps can be disabled by repeating the process for each pump to be disabled. Previously disabled pumps will remain oriented in the +y-direction while subsequent pumps are disabled. Selective actuation could be achieved for two-dimensional or three-dimensional arrays of micro-devices through the concurrent use of x-, y- and z-directed field gradients as known to those skilled in the art. For two-dimensional arrays, a single actuator can be selected by applying x- and y-directed gradients simultaneously using two sets of coils. Alternatively, an entire row of actuators can be selected for disabling if gradients are exerted along only a single axis. For three-dimensional arrays of actuators, a single actuator can be selected by applying x-, y- and z-directed gradients simultaneously using three sets of coils. Alternatively, an entire row of actuators can be selected for disabling if gradients are exerted concurrently along two axes. Alternatively, an entire plane of actuators can be selected for disabling if gradients are exerted along only a single axis. Thus, large numbers of actuators could be simultaneously addressed in a single pulsing step, or sequentially in many steps.

Experiments

A. Reconfigurable Module Demonstration

Figure 7:
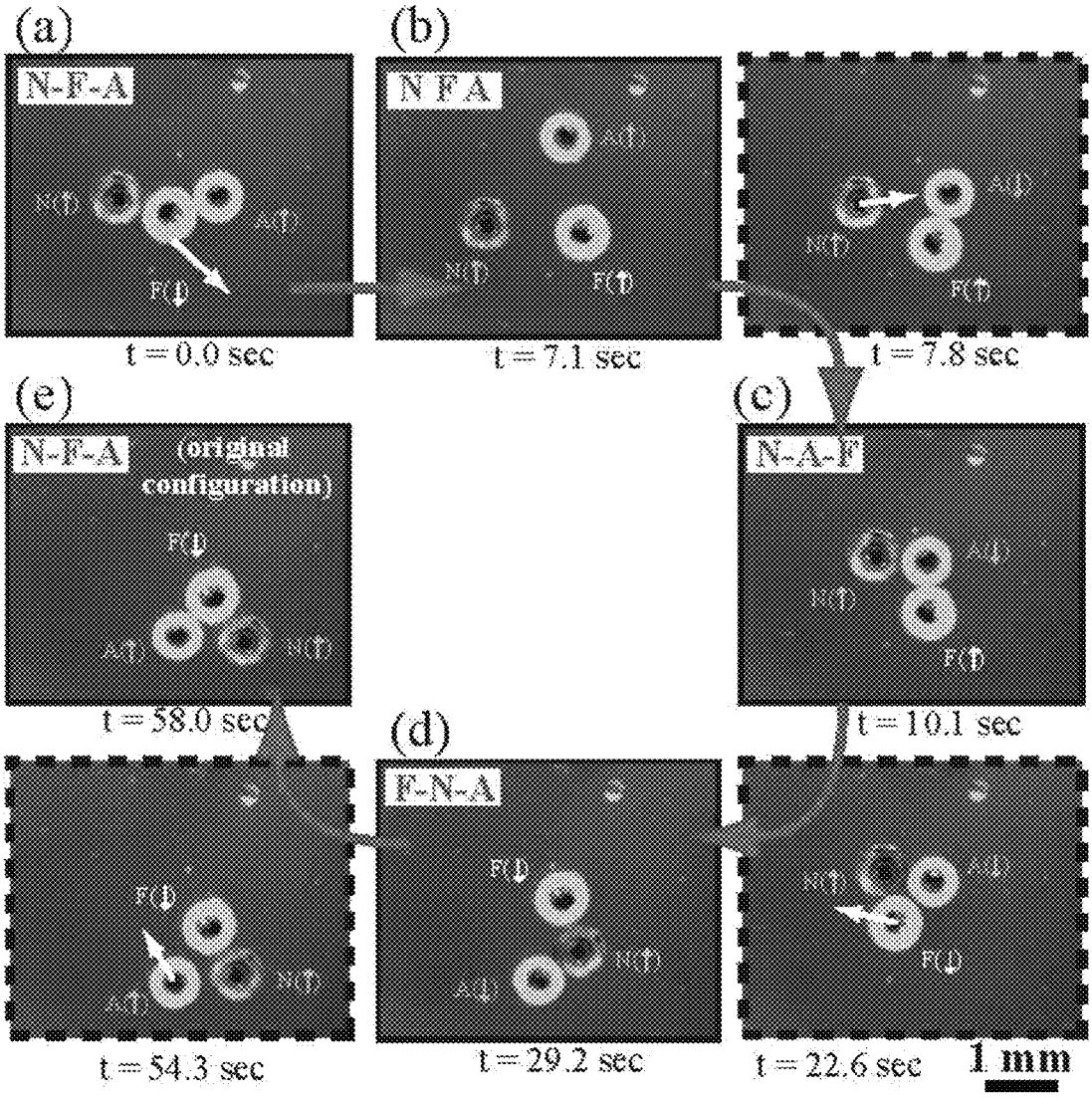
FIG. 7 illustrates frames from a top-down video of self-reconfiguration with one each of round NdFeB (N), alnico (A), and iron (F) modules which are resting on a fluid interface. The magnetization direction of each module is given by an upward or downward arrow in parenthesis. Upcoming module motions are shown with white arrows. All the transition paths between different morphologies are performed, as indicated by the red arrows, with intermediate motion positions shown as insets.
Figures 8A, 8B, 8C, 8D, 8E, 8F:
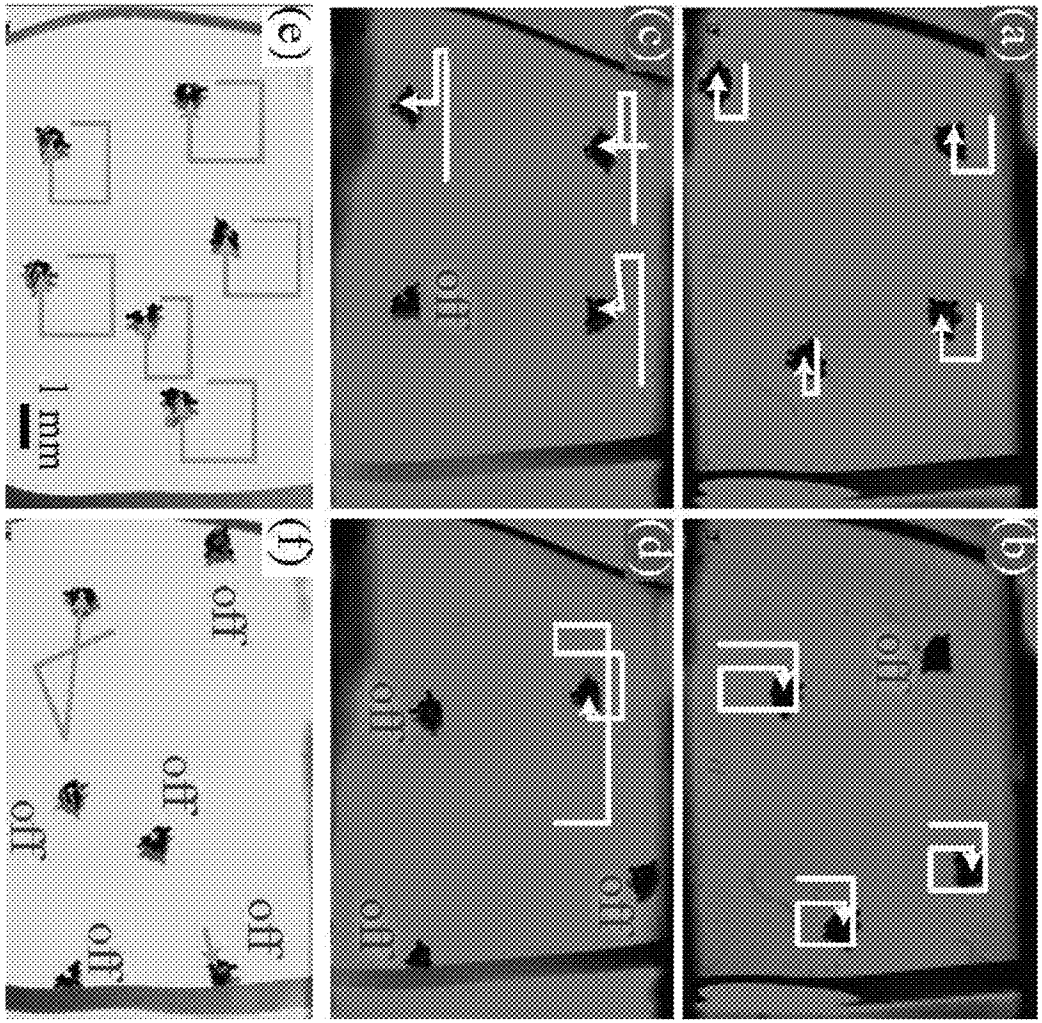
FIGS. 8A-8F are frames from a video of addressable microrobot motion on a 2D glass surface.

The first experimental demonstration involves a set of circular magnetic modules which arrange themselves into different configurations based on the inter-magnetic attractive and repulsive forces. The transition paths were performed between some of the different morphologies possible with a set of three modules in a plane, as shown in FIG. 7. Between each image, the strength and direction of the applied magnetic field is altered to induce a magnetization change in one or more modules, depending on their magnetic properties. In this experiment, one each of round NdFeB (N), alnico (A), and iron (F) modules are used, with widely varying magnetic coercivities as shown in FIG. 1. It is seen that any reorganization of modules is possible, with modules settling into a location of minimum energy based on their magnetic moment directions. The experiment is conducted on a convex liquid interface between water and silicon oil (Dow 200R 5 cSt), such that the weight of the modules pulls them towards the center. It is possible with three modules for the system to become 'trapped' in a local minimum configuration which disrupts the transition process.

Since all the transitions are reversible, the initial configuration can be set to any configuration. In FIG. 7, image (a) is set to N(↑)-F(↓)-A(↑), where N and A each attract to F. By applying a small magnetic field in the upward direction $H_{act}$(↑), the magnetic polarity of only Fe (F) is inverted so that all three modules are repelling (N(↑) A(↑) F(↑)), shown in image (b). In this state, the spacing of the modules can be modulated by changing the applied field strength, which directly affects the F magnetization value. The equilibrium state is where the magnetic repulsion matches the restoring force caused by the sloped liquid surface which pushed the modules towards the center of the workspace. Next, the polarity of the alnico module is switched down using a large $H_{pulse}$ field. This results in both N and F attracting A (N(↑)-A(↓)-F(↑)), shown in image (c). Next, the F is switched down using a weak downward field $H_{act}$(↓), causing it to move from A to N, shown in image (d). Next, the A is switched up using a upward $H_{pulse}$ (↑), causing it to move from N to F, shown in image (e). The system has thus returned to the original configuration (N(↑)-F(↓)-A(↑)).

B. Addressable Mobile Microrobot Demonstration

The next experimental demonstration uses mobile magnetic microrobots which are constructed from the magnetic composite material, allowing for on-off control of each microrobot. Four and six microrobots are moved using stick-slip motion on a glass slide surface in a viscous oil environment. This environment is provided to increase the fluid drag during the pulse to retain the microrobot orientation. The experimental workspace is placed inside the coil system, allowing for both stick-slip motion on the 2D surface using small magnetic fields up to 3 mT and magnetic state changes by a larger field. Independent addressing of the "on" and "off" states of the microrobots is accomplished by $H_{pulse}$, applied in-plane. The motion of the microrobots is captured by camera at 30 frames per second as shown in FIGS. 8*a-f* Frames show microrobot paths traced.

The microrobots are disabled using the methods presented to show addressing of two devices in FIG. 8(*a-f*), which represents one continuous experiment, and show that any combination of microrobot on/off states are achievable. Microrobots in the "off" state are not completely disabled, and vibrate slightly without translating. Microrobots in the "on" state translate in parallel. Here, four microrobots are addressed in FIG. 8(*a-d*) and six in FIG. 8(*e-f*) in a 20 cSt silicone oil environment. This demonstrates the scalability of the presented disabling method. Frame (a) illustrates four microrobots that are enabled and move in parallel. Frames (b-c) illustrate one microrobot as disabled and the others are enabled and move in parallel. Frame (d) illustrates all but one microrobot is disabled, leaving the single microrobot to move. Frame (e) illustrates six microrobots moving in parallel. Frame (f) illustrates all but one microrobot is disabled, leaving the single microrobot to move.

Micro-Pump Switching

Figure 9:
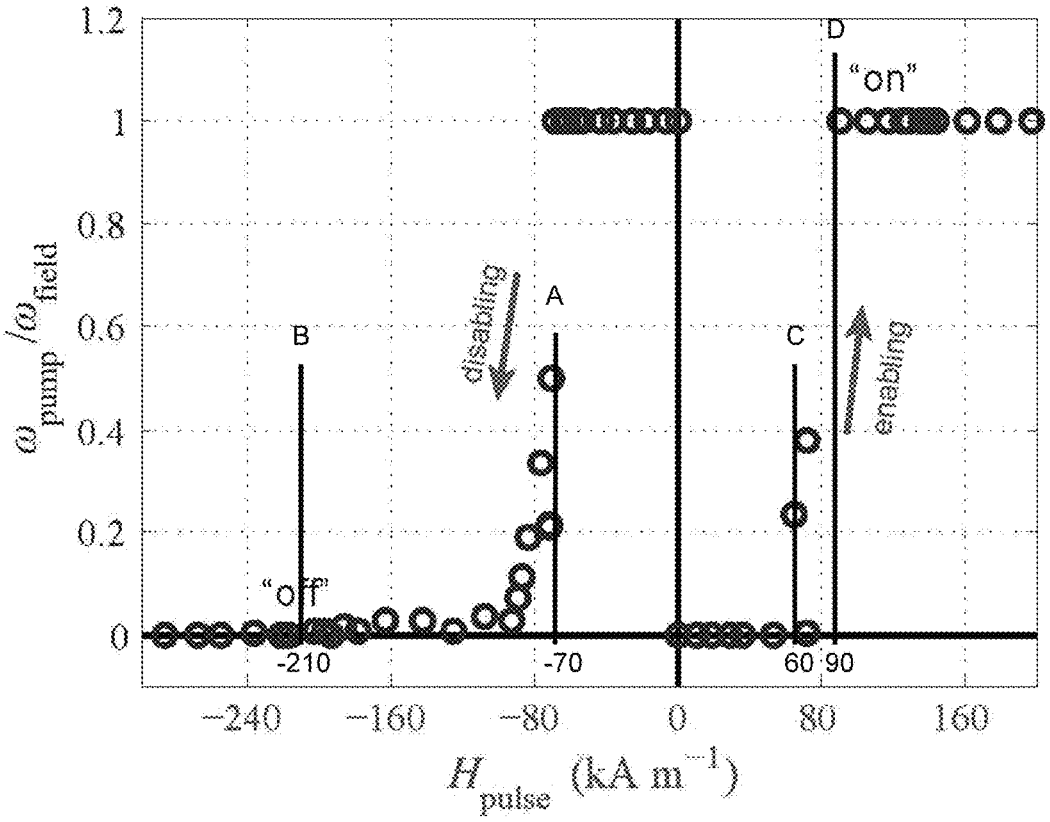
FIG. 9 shows a graph of the results of a test to demonstrate the pumping action of a micropump fabricated and controlled according to the present invention.

A 800×800×75 $\mu m^3$ micro-pump fabricated and controlled according to the present invention was tested in-situ to characterize the magnetic switching behavior. The simple remote motion actuation task used to test the micro-pump consisted of finding the rotation rate of the micro-pump in the presence of a 5 Hz rotating magnetic field of magnitude 5.0 kA $m^{-1}$. The rotation rate was observed visually from experimental video taken at 70 Hz. Each "enabling" experiment began with the device fully "off" from $H_{pulse}$=240 kA $m^{-1}$ in the backward direction. Then $H_{pulse}$ of various strengths was applied in the forward direction to turn "on" the device. These data points were shown as positive $H_{pulse}$ values in FIG. 9. Each "disabling" experiment began with the device fully "on", with $H_{pulse}$ of various strengths applied in the backward direction to turn "off" the device. These data points are shown as negative $H_{pulse}$ values in FIG. 9. Motion actuation was taken as the rotation speed of the micro-pump $\omega_{pump}$, normalized by the rotation speed of the applied field $\omega_{field}$, showing clear micro-pump "on" and "off" states. Negative $H_{pulse}$ correspond to pulsing in the backward direction, and are used to disable the device from the "on" state. It is seen that the device remains fully "on"

with negative pulses less than 70 kA $m^{-1}$ (line A), and becomes fully "off" with negative pulses greater than 210 kA $m^{-1}$ (line B). Similarly, positive $H_{pulse}$ corresponds to pulses in the forward direction, and is used to enable the device from the "off" state. It is seen that the device begins to enable with positive $H_{pulse}$ around 60 kA $m^{-1}$ (line C), and becomes fully "on" at around $H_{pulse}$=90 kA $m^{-1}$ (line D). This sharp change in actuation for a critical $H_{pulse}$ magnitude is advantageous, and shows that the magnetization of the device need not be completely disabled to prevent the microdevice from rotating at full speed.

Two Micro-Pump Switching Demonstration

The control methods of the present invention enable the selective control of individual micro-actuators in the presence of two or more micro-actuators. In an exemplar demonstration of this capability, we placed two 800 μm micro-pumps fabricated as described above in polyurethane micro-channels similar to those used in conventional micro-fluidic devices as shown schematically in FIG. 10A. Polyurethane was used in place of the usual polydimethylsiloxane because polyurethane shows lower adhesion with the micro-pumps. Each micro-pump was placed offset in the channel to provide the pumping motion well known in the art and was constrained to its location by a polyurethane post in the center of the offset region. After placement of the micro-pumps in their channels, a glass cover slip was bonded to the top of the polyurethane to enclose the channels. Light pressure was applied to ensure a close seal between the polyurethane layer and the glass. The entire assembly was then placed in the electromagnetic coil system described above for actuation.

The flow in each independent channel was visualized by optically tracking small suspended black particles of approximate size 10-50 μm in the 5 cSt silicone oil liquid. The fabricated micro-pumps were disabled using the methods described above to show addressing of two devices in FIGS. 10B-E, which represent one continuous experiment, and show that any combination of micro-pump states are achievable. Pumps in the "off" state are not completely disabled, and so vibrate slightly without rotating, resulting in no fluid motion.

Five Micro-Device Switching Demonstration

The control methods of the present invention enable the selective control of individual micro-actuators in the presence of two or more micro-actuators. In another exemplar demonstration of the capabilities for scalable micro-device addressability using the methods presented, an array of five simple magnetic micro-actuators were addressed, as shown in FIGS. 11A-F. In this exemplar demonstration, 600 μm arrow shapes rotate about polyurethane posts on a polyurethane surface in silicone oil of viscosity 20 cSt without the added complexity of the micro-channels as a proof-of-concept demonstration.

Figure 11A:
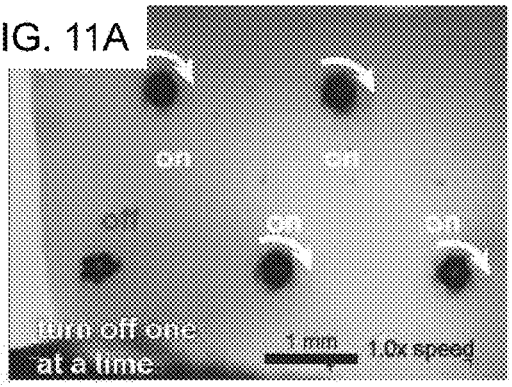
FIGS. 11A-11F show frames from a video of five addressable micro-actuators fabricated and individually controlled according to the present invention.
Figure 11B:
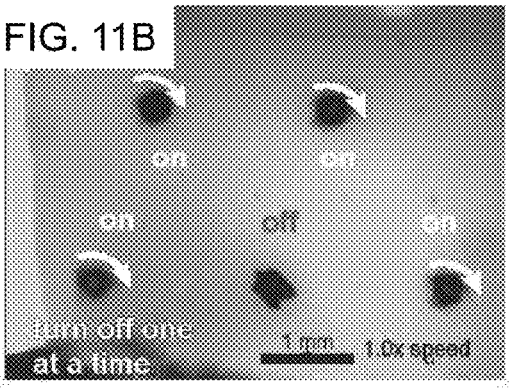
Figure 11C:
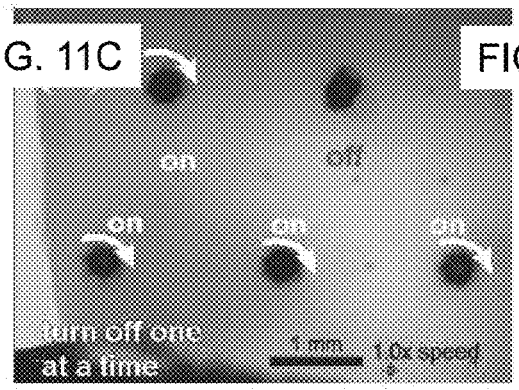
Figure 11D:
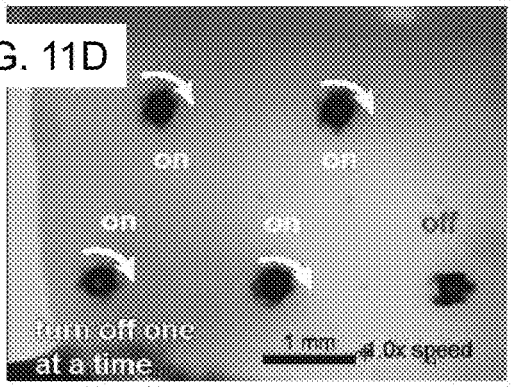
Figure 11E:
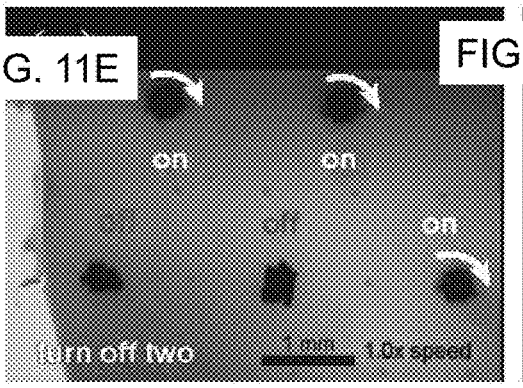
Figure 11F:
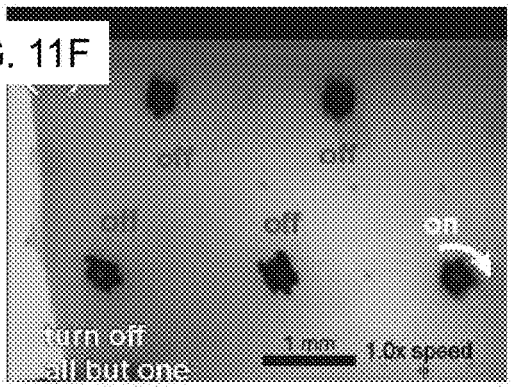
Figures 12A, 12B, 12C, 12D:
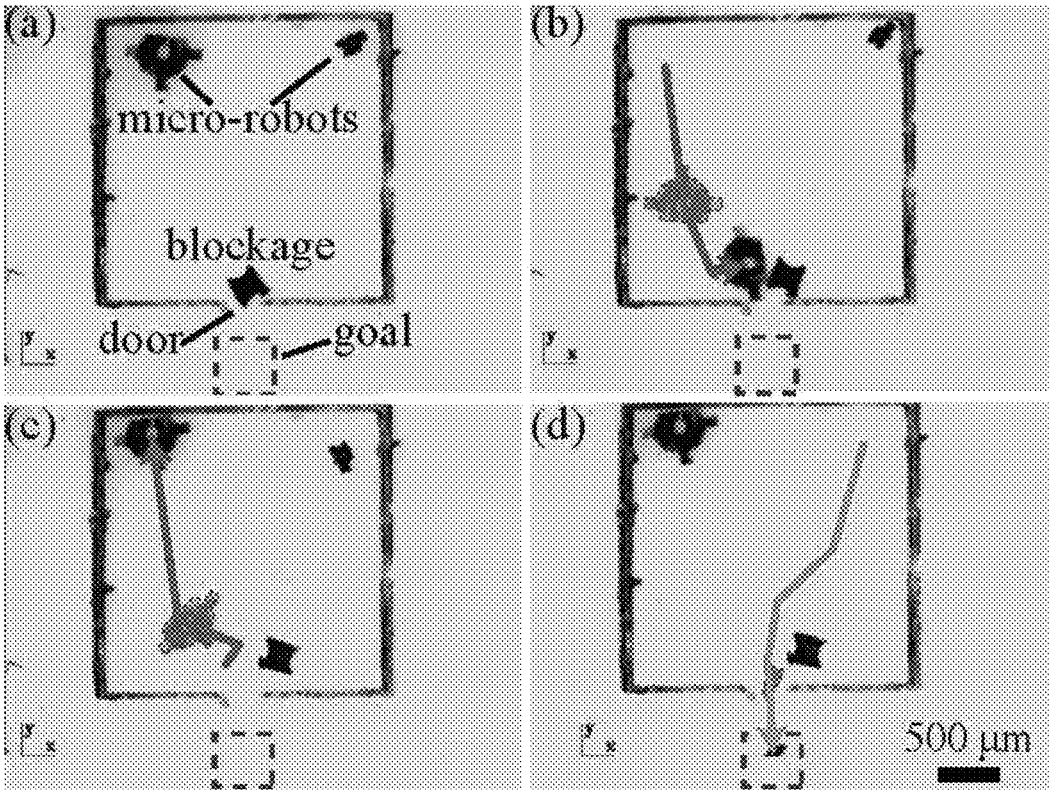
FIGS. 12A-12D are frames from a video showing a cooperative teamwork task with two mobile microrobots of different sizes working together to reach a goal.

It is shown in FIGS. 11A-D that any device can be disabled while all other devices remain "on" and in FIG. 11F that all devices but one can be turned "off". In addition, to turn "off" more than one device, a multi-step method is used starting with a single disabled pump. This disabled pump now maintains its orientation.

Then, the second pump to disable is selectively oriented to align with the already disabled pump. At this point, a pulse turns the second device "off". In this way, any desired combination of devices can be turned "on" or "off", as seen in FIG. 11E.

To demonstrate the usefulness of a team of microrobots, a simple cooperative teamwork task is shown in FIGS. 12*a-d*, where two microrobots of different sizes attempt to reach a goal location. Frames show two superimposed frames, with the microrobot paths traced. Here, the two microrobots begin trapped in an enclosed area. The door to the goal is covered by a plastic blockage. As the large microrobot is too big to fit through the door and the small microrobot is too small to move the blockage, both must work together as a team to reach the goal. In FIG. 12(*b*), the larger microrobot is enabled, and moves to remove the blockage while the smaller disabled microrobot remains in place. In FIG. 12(*c*) the larger microrobot is returned to its staring point and disabled. Finally in FIG. 12(*d*) the smaller microrobot is enabled and is free to move through the door to the goal. The arena walls are made from polyurethane molded in a replica molding process similar to that used to fabricate the molded microrobots.

A microscale magnetic addressability concept can be demonstrated which uses the magnetic hysteresis characteristics of several magnetic materials to achieve independent control of the magnetic state of a number of actuators, as shown two cases. The first case uses one magnetic material for each microrobotic element, allowing for independently addressable magnetic switching of each module into up or down states. Further, a 3-module reconfigurable assembly was created on a 2D surface that could be reconfigured into any connected state by inter-module magnetic attraction forces.

As a second case, two magnetic materials were paired into a composite that can be remotely and repeatedly switched between "on" and "off" states by an externally-generated magnetic field pulse. The switching behavior was found to clearly reduce the motion actuation of magnetic microrobots in the "off" state to nearly zero. Through the use of spatial magnetic field gradients, single or multiple microrobots were selected for disabling, leading to addressable motion behavior for multiple microrobots moving on a 2D surface. The scalability of the present invention was demonstrated by independently controlling up to six microrobots, and the usefulness of such an addressable concept demonstrated through a maze task which required the coordinated contributions from two microrobots. In addition to the two-dimensional (2D) magnetic actuation, any miniature robot or device moving in three-dimensions (3D) by magnetic levitation, pulling, rotation or swimming actuation could use the same addressable switching method for multi-actuator control.

The overall size of the remotely addressable magnetic composite actuators in this invention could range from 10 nanometers up to 1 meter. Also, these actuators could create two- or three-dimensional motion for a robot or a device. Moreover, these actuators could function in air, liquid or vacuum.

Although the microrobots shown are around 300-800 μm in size, the presented addressability concepts are expected to scale smaller or larger without change in performance as long as the magnetic properties are maintained. High viscosity liquid was used in this study to allow for easier disabling, but liquid such as water could be used if the charge voltage of the pulsing circuit is increased several times and the capacitance reduced, allowing a faster pulse rise time with the same $H_{pulse}$ peak value. Alternatively, if the device size is increased by several times, a less viscous liquid could also be used. The addressable magnetic composite microdevice concept can be extended to other microscale systems using magnetic actuation, and the composite material can be simply molded into any desired shape. Uses of this switching device as an addressable actuation method include microfluidic valves, and other magnetic actuators at the micron, mm and cm-scales.

Other embodiments of the present invention are remotely actuated micro-devices with on-board tools or mechanisms, such as untethered Magnetic Robotic Micro-Grippers, capable of Three-Dimensional Programmable Assembly. One such embodiment is a flexible patterned magnetic material that allows for internal actuation, resulting in mobile untethered micro-grippers, which are driven and actuated by magnetic fields. By remotely switching the magnetization direction of each micro-gripper arm, a gripping motion is demonstrated, which can be combined with locomotion for precise transport, orientation and programmable three-dimensional (3D) assembly of micro-parts in remote, confined or enclosed environments. This device allows for the creation of out-of-plane new 3D structures and mechanisms made from heterogeneous building blocks. Using multiple magnetic materials in each micro-gripper, addressable actuation of gripper teams for parallel, distributed operation is also demonstrated. These mobile micro-grippers can potentially be applied to 3D assembly of heterogeneous meta-materials, construction of medical devices inside the human body, the study of biological systems in micro-fluidic channels, 3D micro-device prototyping, and desktop micro-factories. These mobile manipulators can orient and assemble objects in 3D due to their gripping precision and motion sophistication.

As stated above, the present invention is a flexible magnetic material with patterned and dynamic magnetization allowing for the creation of untethered mobile micro-grippers with remote magnetic actuation. These grippers can be moved and actuated using magnetic fields of varying strength using existing mobility methods such as magnetic gradient-based 3D pulling or field-based 2D rotational stick-slick locomotion. The ability to position and orient the gripper in 3D space allows the micro-grippers to transport and assemble building blocks into out-of-plane or other 3D arrangements. Such assembly will allow for the creation of complex 3D micro-materials made from heterogeneous building blocks, which can be arranged in a programmable and dynamic manner in a remote or enclosed environment. These assemblies could form actuators inside microfluidic devices, complex meta-materials, or be used for patterned cell structures. General programmable and dynamic assembly in remote or enclosed spaces is not possible by other methods. The advantage of this work over previous micro-grippers is that the gripper itself is mobile and untethered, yet capable of precise gripping. This can allow the gripper to noninvasively access small, enclosed spaces for out-of-plane 3D manipulation and assembly tasks.

Figures 13A, 13B, 13C, 13D, 13E, 13F, 13G, 13H:
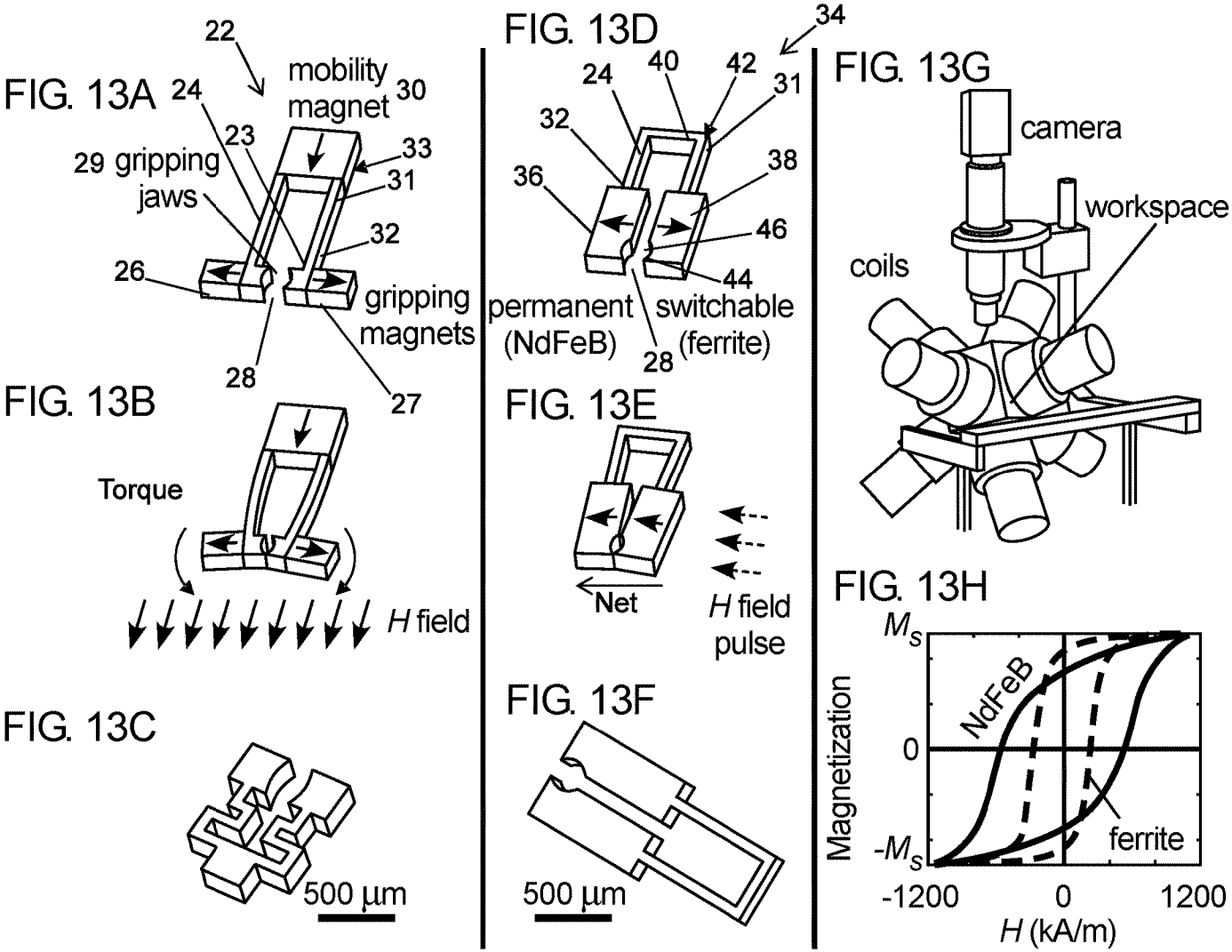
FIGS. 13A-13H illustrate various remotely-actuated untethered micro-gripper designs of the present invention.

Now turning to FIGS. 13*a-h* illustrating remotely actuated untethered micro-gripper designs. The two-finger based micro-gripper 22 is made of flexural mechanisms to reduce complications with micro-scale friction and adhesion, which could be present with sliding or rotating mechanisms. The fabrication of micro-scale flexures is also relatively straightforward compared with traditional sliding or rotating mechanisms. The flexures allow for actuating torques or forces to result in gripper opening and closing, and were designed to be compact in size. The result is a single-piece, compliant and elastically deformable, U-shaped magnetic micro-gripper 22 (FIGS. 13*c* and 13*f*). To increase speed and throughput of a manipulation operation using a mobile micro-gripper 22, it could be beneficial to operate multiple untethered micro-grippers simultaneously in parallel. This would require an individually addressable magnetic control input to the gripping operation of each micro-gripper. Here, the present invention method can address each magnetic micro-gripper through the use of multiple magnetic materials.

The gripping concept is shown in FIGS. 13*c* and 13*f*, and encompasses two different magnetic gripping schemes. The first scheme is referred to as a 'torque-based' gripper 22, as the gripper arms 24, which are magnetized in opposite directions, are actuated by applied magnetic torques. This gripper is made from a single type of permanent magnetic material throughout (e.g., same coercivity field). The torque-based gripper 22, shown in FIGS. 13*a* and 13*b*, is opened and closed by application of constant uniform magnetic fields applied in a direction perpendicular to the magnetization directions of the gripping magnets 26, 27 (which exerts a torque on each gripper arm), and can be quickly and reversibly opened to a specified gap 28. The magnetization directions of the magnets 26, 27 are oriented in outwardly opposing directions in the open position. The design includes a 'mobility magnet' 30 connected to the proximal end 31 of arms 24 acting as a cross member to form frame 33. Mobility magnet 30 is used to propel the gripper 22 as a mobile micro-robot. The mobility magnet 30 serves no purpose in the gripping action. The 'gripping magnets' 26, 27 are at the distal end 32 of the flexible, compliant, elastically deformable gripper arms 24, and experience magnetic torque due to a uniform applied field (H field). The gripper 22 can be designed to be open with gap 28 (FIG. 13*a*) where there is no applied field to received and to release an object, or closed where an applied field H perpendicular to the magnetization directions of magnets 26, 27 is used to grip the object (FIG. 13*b*) by closing gap 28, meaning a torque is applied to magnets 26, 27. The magnetization directions of the magnets 26, 27 are oriented in outwardly opposing directions. Note that the magnetization direction of the gripping magnets 26, 27 do not change their outwardly opposing orientation shown by the arrows pointing away from each other. The micro-gripper 22 can also include a gripping jaw 29 disposed on an inner surface 23 of each distal end 32 of the two arms 24 such that the gripping jaws 29 are opposingly oriented. FIG. 13*c* is a scanning electron microscope (SEM) image of a fabricated torque-based addressable micro-gripper 22.

The second scheme, the 'force-based' gripper design 34, is shown in FIGS. 13*d*, 13*e*, and 13*fe* and uses a different magnetic material 36, 38 attached to the distal end 32 each gripping arm 24. A cross member 40 replaces a mobility magnet 30 of gripper 22 to form frame 42. One material is permanently magnetized, for example magnet 36, while the other, for example magnet 38, can be switched by application of a large field pulse, $H_{field\ pulse}$. This scheme uses a latching-type mechanism, in that it does not require a static externally applied field to maintain the closed or open state as discussed above for the torque-based micro-gripper 22. Instead, a short magnetic field pulse, $H_{field\ pulse}$, is used to change the gripper state from open (FIG. 13*d*) to closed (FIG. 13*e*). In this design, magnets 36, 38 are designed to magnetically attract or repel depending on their relative magnetization direction (shown as arrows). If the magnets 36, 38 are magnetized in parallel (outwardly opposing each other), they will repel and the gripper 34 will be open to form gap 28, as in FIG. 13*d*, meaning the magnetization directions of the magnets 36, 38 are oriented in outwardly opposing directions in the open position. If magnet 38 is remagnetized remotely such that the two magnets 36, 38 are magnetized anti-parallel, they will attract (net movement of magnet 38 towards magnet 36) and the gripper 34 would close gap 28, as in FIG. 13*e*, meaning the magnetization directions of the magnets 36, 38 are oriented in a same direction in the closed position. Thus, the state can be remotely changed using a field pulse in the requisite direction. The micro-grippers 34 have a preferred forward direction, allowing for multiple grippers to be addressed remotely depending on their orientation when the field pulse is applied. This will be used to achieve addressable open-closed behavior of a set of micro-grippers 34 sharing the same workspace, although a different addressing method will be required to individually control the micro-gripper motion. For many gripping applications, parallel micro-gripper motion with addressable gripping could be useful to achieve parallel payload movement. The micro-gripper 34 can also include a gripping jaw 44 disposed on an inner surface 26 of magnets 36, 38 such that the gripping jaws 44 are opposingly oriented. FIG. 13*f* is a scanning electron microscope (SEM) image of forced-based addressable micro-gripper.

Low-strength magnetic fields are applied to move and actuate mobile grippers 22, 34 using the coil system shown in FIG. 13*g*, with details given in the methods section. With gripper 34, two different magnetic materials are used in this device, which can be remagnetized at different critical fields, known as the coercive fields. The magnetic hysteresis loop of the two materials, NdFeB and ferrite, are shown in FIG. 13*h* for a range of magnetic fields H. The material NdFeB has a larger magnetic coercivity, and in this device applied fields are not large enough to switch its magnetization. The ferrite, however, can be switched at moderate fields of about 400 kA/m, allowing for dynamic remagnetization of this single material.

In summary, FIG. 13 frames (a-c) illustrate a torque-based addressable micro-gripper of the present invention. This micro-gripper is closed by application of a constant uniform magnetic field (H field), which exerts a torque on each gripper arm. The 'mobility magnet' acts to move the gripper as a mobile micro-robot. Frame (c) is a scanning electron microscope (SEM) image of a fabricated torque-based gripper. Frames (d-f) illustrate a force-based addressable micro-gripper of the present invention. The gripping state is changed through the application of a large magnetic field pulse (H field pulse), which switches the ferrite magnet magnetization directions. This changes the arms from a repulsive to attractive state. The micro-gripper can be re-opened by applying a field pulse in the opposite direction. Frame (f) is a SEM image of the fabricated force-based gripper. Frame (g) illustrates a magnetic coil system used to apply low and moderate fields of up to 22 kA/m. Frame (h) are plots of magnetization hysteresis loops of NdFeB and ferrite magnetic materials used with the present invention, as measured in an alternating force gradient magnetometer. This shows the magnetization of the permanent material NdFeB and the switchable material ferrite as a function of applied field H. Both curves are normalized to the saturation magnetization $m_s$ of each material.

Figure 22A:
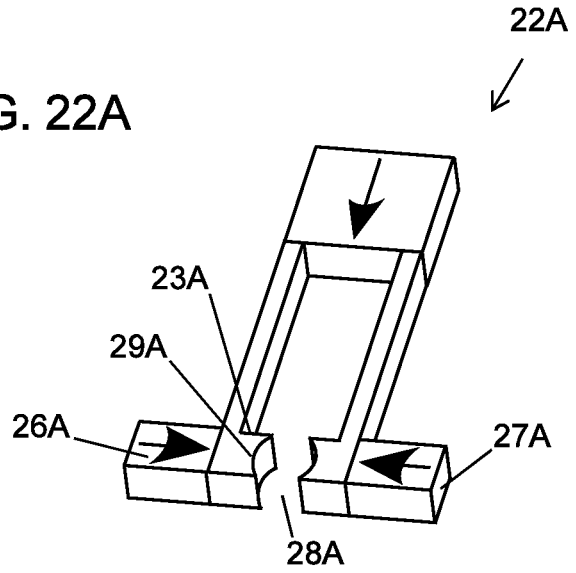
FIGS. 22A and 22B illustrate an alternative embodiment of a remotely-actuated untethered micro-gripper design of the present invention.
Figure 22B:
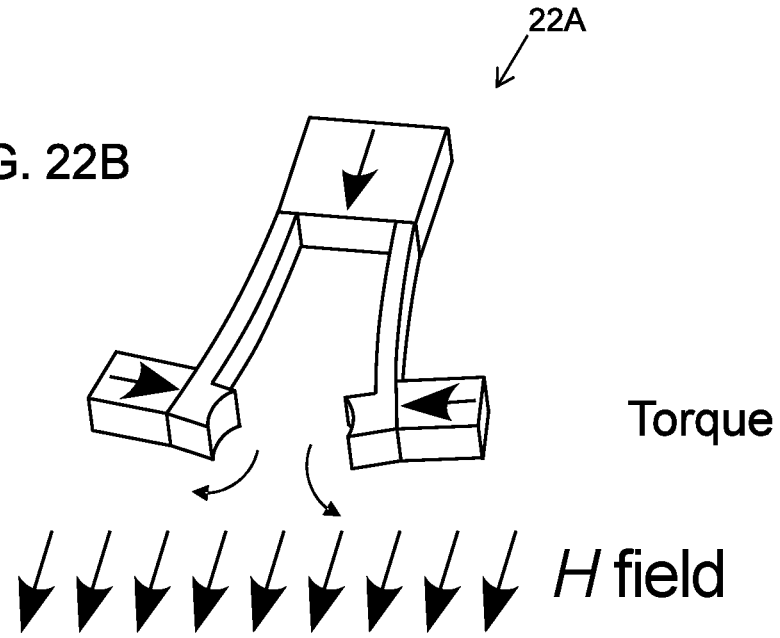

An alternative gripper 22A can be designed to close gap 28A (FIG. 22A) where there is no applied field to grip an object, or open gap 28A where an applied field H perpendicular to the magnetization directions of magnets 26A, 27A is used to release or received the object (FIG. 22B), meaning a torque is applied to magnets 26A, 27A. The magnetization directions of the magnets 26A, 27A are oriented in inwardly opposing directions. Note that the magnetization direction of the gripping magnets 26A, 27A do not change their inwardly opposing orientation shown by the arrows pointing towards from each other. The micro-gripper 22A can also include a gripping jaw 29A disposed on an inner surface 23A of each distal end 32A of the two arms 24A such that the gripping jaws 29A are opposingly oriented. Note the torque applied to gripper 22A is in the oppose direction of the torque applied to gripper 22. In general, micro-gripper 22, 34 can include: a frame 33, 42 having two arm members 24 and a cross member 30, 40, wherein each arm member 24 includes a proximal end 31 and a distal end 32, wherein the proximal ends 31 of the two arm members 24 are connected to the cross member 30, 40 forming a parallel orientation between the two arm members 24, wherein the two arm members 24 are made of compliant and elastically deformable material; and a first element (e.g., magnet 26, 36) and a second element (e.g., magnet 27, 38) connected to the distal ends 32 of the two arm members 24, wherein an open position gap 28 is formed between the first element 26, 36 and the second element 27, 38 in an open position, wherein the open position gap 28 is sized to receive a desired object. The first element 26, 36 is made of at least one magnetic material, wherein the at least one magnetic material has a first element coercivity field. The second element 27, 38 is made of at least one magnetic material, wherein the at least one magnetic material has a second element coercivity field. The two arm members 24 elastically bend towards each other in the presence of an applied field to form a closed position gap 28 to retain the desired object between the first elements 26, 36 and second elements 27, 38 in a closed position. The two arm members 24 elastically return to the parallel orientation therewith in the absence of the first applied field or in the presence a second applied field in the opposite direction of the first applied field. The cross member 30 (e.g., mobility magnet) is made of at least one magnetic material having a cross member coercivity field. The first applied field can be a field pulse. The field pulse greater than the second element coercivity field and less than the field element coercivity field changes a magnetization direction of the second element 27, 38 and does not change a magnetization direction of the first element 26, 36 whereby a magnetic attractive state between the second element 27, 38 and the first element 26, 36 increases causing the second element 27, 38 to be drawn towards the first element 26, 36 forming the closed position gap. The first applied field can be oriented parallel with magnetic fields of the first element 26, 36 and the second element 27, 38. The first applied field can be oriented perpendicular with magnetic fields of the first element 26, 36 and the second element 27, 38. The at least one magnetic material of the second element 38 has a magnetic hysteresis loop characteristic.

To fabricate micro-grippers from soft elastomer with included magnetic particles, a replica molding technique is used (see Steps a and b of FIG. 14). The process, shown in FIGS. 19*a-d* and discussed below), includes shape definition by photolithography, replica molding to achieve flexible elastomer gripper shapes, and a magnetization process unique to the 'torque-based' and 'force-based' designs. This magnetization process is shown in FIG. 14. Torque-based designs require that each gripper tip be magnetized in an opposite direction, which is accomplished at the magnetization step by deforming the micro-gripper arms 90° prior to magnetization. If it is desired to remove this deflection step, the gripper can be made in three pieces, which are magnetized individually, and epoxied back together. Another alternative could use a tightly focused magnetic field during magnetization (e.g. through the use of magnetic pole pieces and pulsed field application) to selectively magnetize individual gripper sections, or the use of applied fields during the gripper molding step to introduce a preferred magnetization direction directly during fabrication. The force-based gripper is made from two different magnetic materials, which are molded in two separate batches and epoxied back together. To aid in precise assembly of these two pieces during this gluing step, they are placed into the rubber mold as a jig to hold them in place. The force-based gripper design is magnetized in one common direction, spanning the two gripper arms such that the magnetic moments of the arms are coaxially aligned and parallel.

A number of different torque- and force-based micro-gripper designs are fabricated, differing primarily in flexure design. The designs for a number of different flexures are shown in FIGS. 19*e-i* and discussed below. Each micro-gripper is designed to have the same flexure deflection (resulting in 100 μm tip deflection with an applied field of 7.5 kA/m), and it is seen that the use of a meandering spring in the design results in a more compact design. This could be critical in accessing small spaces with the mobile micro-gripper.

Returning to FIG. 14 illustrates micro-gripper fabrication and magnetization process of one embodiment of the present invention. Step (a) is a magnetic slurry consisting of magnetic micro-particles and polymer binding matrix is poured into the negative mold. Details of mold fabrication discussed below in (FIGS. 19*a-d*). Step (b) illustrates microgripper shapes pulled from the mold using tweezers. Step (c) illustrates torque-based designs are spread open prior to magnetization, to allow each gripper tip to be magnetized in an opposite direction. The bend direction shown here will result in a gripper which is closed when no field is applied. Force-based microgrippers are molded from two magnetic materials, in two separate molding batches. The pieces are fixed together using UV-curable epoxy using a rubber mold as a jig to hold the parts precisely. These force-based gripper tips are magnetized in one common direction. Step (d) illustrates the grippers after relaxation and shown in their final magnetic configurations. Step (e) are SEM images of fabricated designs shown in the relaxed state after magnetization and assembly. Steps (f-g) illustrate deflection of microgripper tips under applied (f) fields for torque-based and (g) field pulses for force-based grippers. Circles represent mean of five experiments taken for various field or field pulse values. The lines indicate the theoretical model, with details given in the supplementary files.

Figure 14A:
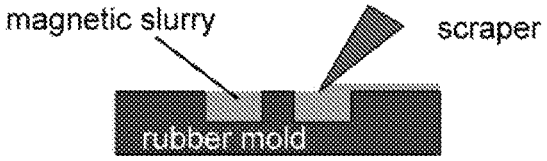
FIG. 14 illustrates micro-gripper fabrication and magnetization process of one embodiment of the present invention.
Figure 14B:
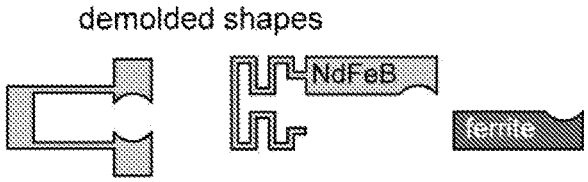
Figure 14C:
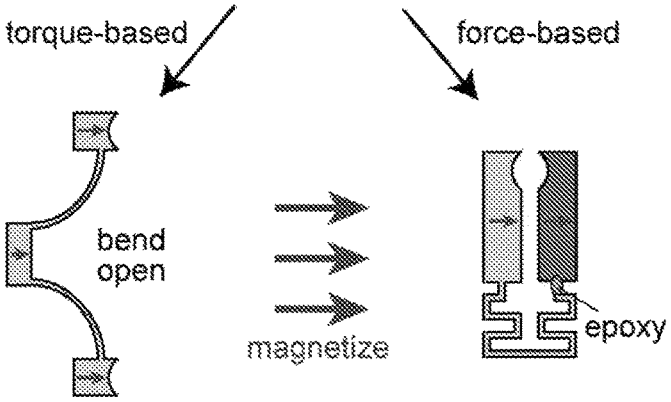
Figure 14D:
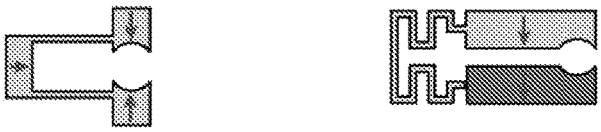
Figure 14E:
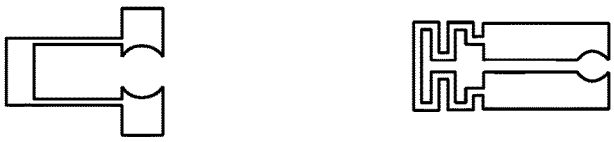
Figure 14F:
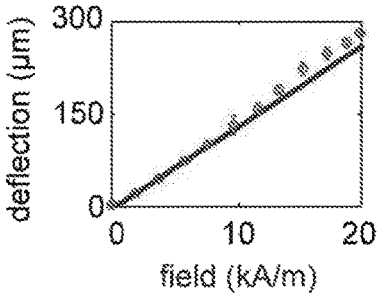
Figure 14G:
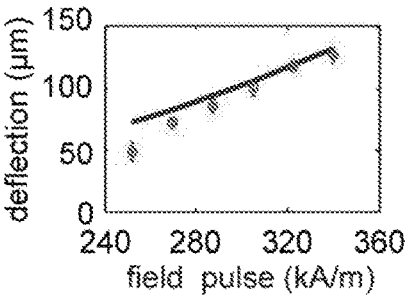

The gripper tip deflection for torque-based and force-based designs is characterized under different field and field pulse values, as shown in FIG. 14*f*. Circles represent the mean of five experiments taken for various field or field pulse values. The lines indicate the theoretical model, details of which are given in the supplementary materials. The material elastic modulus value used in the model is calibrated from two different grippers with different flexure designs. The same modulus value is used in the simulation for the force-based gripper, with results shown in FIG. 14*g* for a range of applied field pulse values. In this experiment, a reverse pulse of 450 kA/m was applied after each pulse to close the gripper. For opening, field pulses less than 240 kA/m, the change in gripper deflection is negligible. The upper limit for applied field and field pulse represent the maximum capabilities of the present invention coil system.

Mobile micro-grippers are moved and oriented using low-strength magnetic fields and spatial field gradients. Acting on the net magnetic moment of the gripper, magnetic fields exert torques, which act to align the net moment with the field, and field gradients exert forces, which tend to pull the gripper towards local field maxima. Thus, precise forces and torques can be applied to achieve five-degree-of-freedom control over the gripper (no magnetic torque can be exerted about the net moment direction). The grippers are moved in 2D by applying magnetic forces in conjunction with oscillating magnetic torques, which serve to break the friction with the substrate, and in 3D by magnetic force which can levitate the grippers in liquid environments. Micro-grippers can thus be positioned with oriented in 3D space with a precision of tens of micrometers using visual feedback through a microscope. Control in this work is under teleoperation, but an autonomous controller can be developed for specific tasks.

Using controllable motion in 2D or 3D, mobile robotic micro-grippers are able to assemble structures in 3D with functional components. FIGS. 15*a-g* show video frames a-g of the assembly of a spinning 'T'-shaped magnetic micro-part into a hole in the substrate using a mobile robotic micro-gripper. Frames a-g illustrate a normally closed torque-based gripper assembles a 'T'-shaped polyurethane and magnetic part in an out-of-plane configuration into a hole in the substrate. Frame (a) illustrates the gripper approaching the object with the gripper tips opened by application of a large field. Frame (b) illustrates the object moved along with the gripper once it grabbed. Frame (c) illustrates the object tip being placed at the opening of the hole, and the gripper raised up to insert the part. Frame (d) illustrates the gripper releasing the part and moving away after insertion of the part. At this point, the 'T'-shaped magnetic part is magnetized by a high-strength magnetic field pulse. Frame (e) illustrates that the 'T'-shape can now be rotated by low-strength magnetic fields for non-contact fluid manipulation. Tracer beads are added to the liquid to show the fluid flow. Frame (f) illustrates the rotation of the 'T' matches closely with the rotation of the applied field at a field magnitude of 13 kA/m. Frame (g) is a computer rendering of the assembled out-of-plane structure. Frames (h-r) illustrate assembly of an out-of-plane 3D four-bar linkage, where Frames (h-j) illustrate the gripper approaching the first vertical bar, grabbing it and placing it in the first hole; Frames (k-l) illustrate the gripper assembling the second vertical bar; Frame (m) illustrates that the bars are rotated to the precise orientation for addition of the cross-beam; Frames (n-o) illustrate the gripper assembling a nylon cylinder on top of one vertical bar. The cylinder is outlined with dotted lines for visibility; Frame (p) illustrates the gripper lifting the cylinder onto the second vertical bar. Time indicated on each pane is minutes:seconds, and Frames (q-r) are schematic and SEM images of the assembled 3D structure.

Figures 15A, 15B, 15C, 15D, 15E, 15F, 15G, 15H, 15I, 15J, 15K, 15L, 15M, 15N, 15O, 15P, 15Q, 15R:
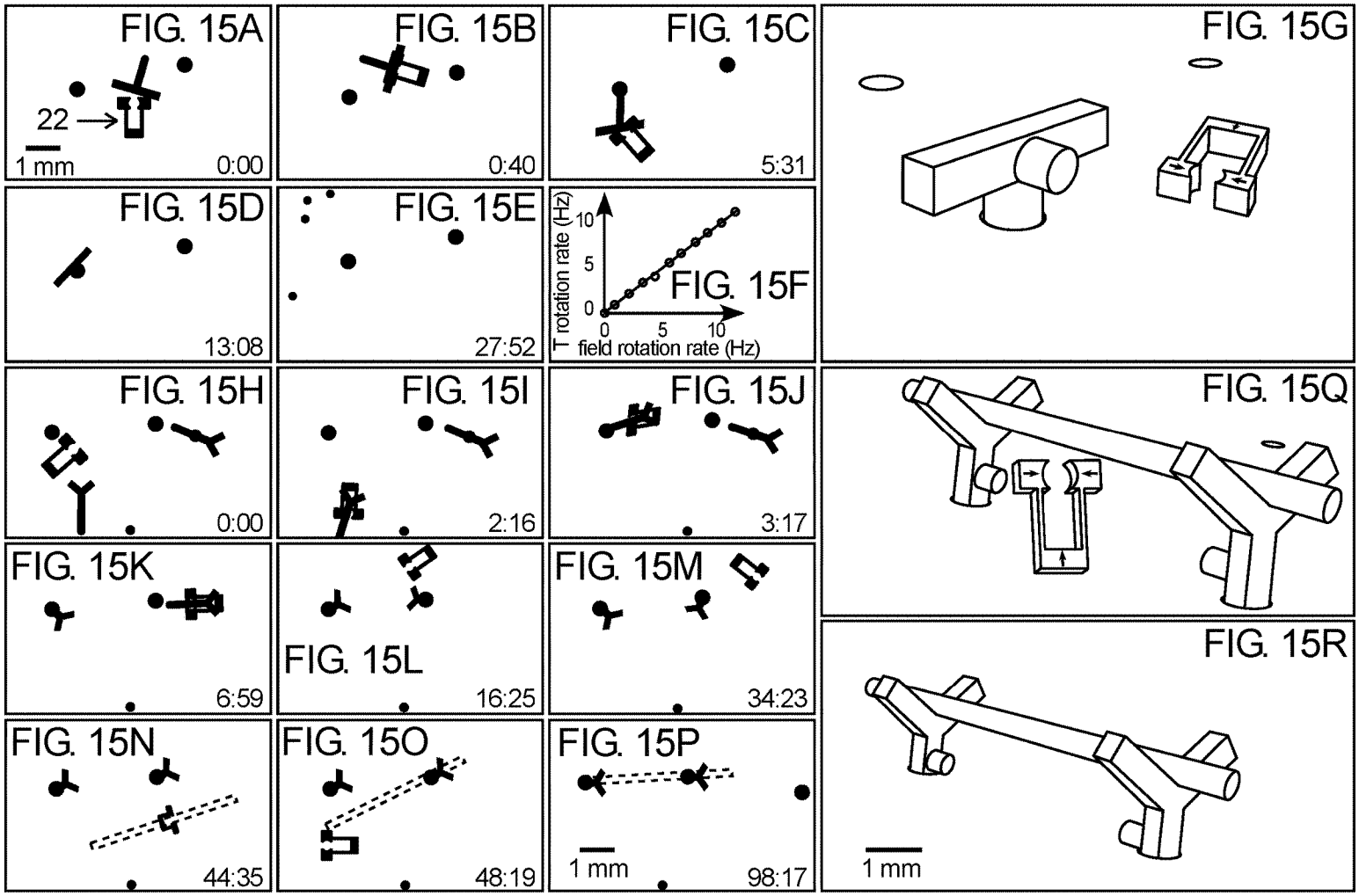
FIGS. 15A-15R illustrate video frames of a demonstration of 3D micro-assembly using a mobile robotic micro-gripper.
Figures 16A, 16B, 16C, 16D, 16E, 16F, 16G, 16H:
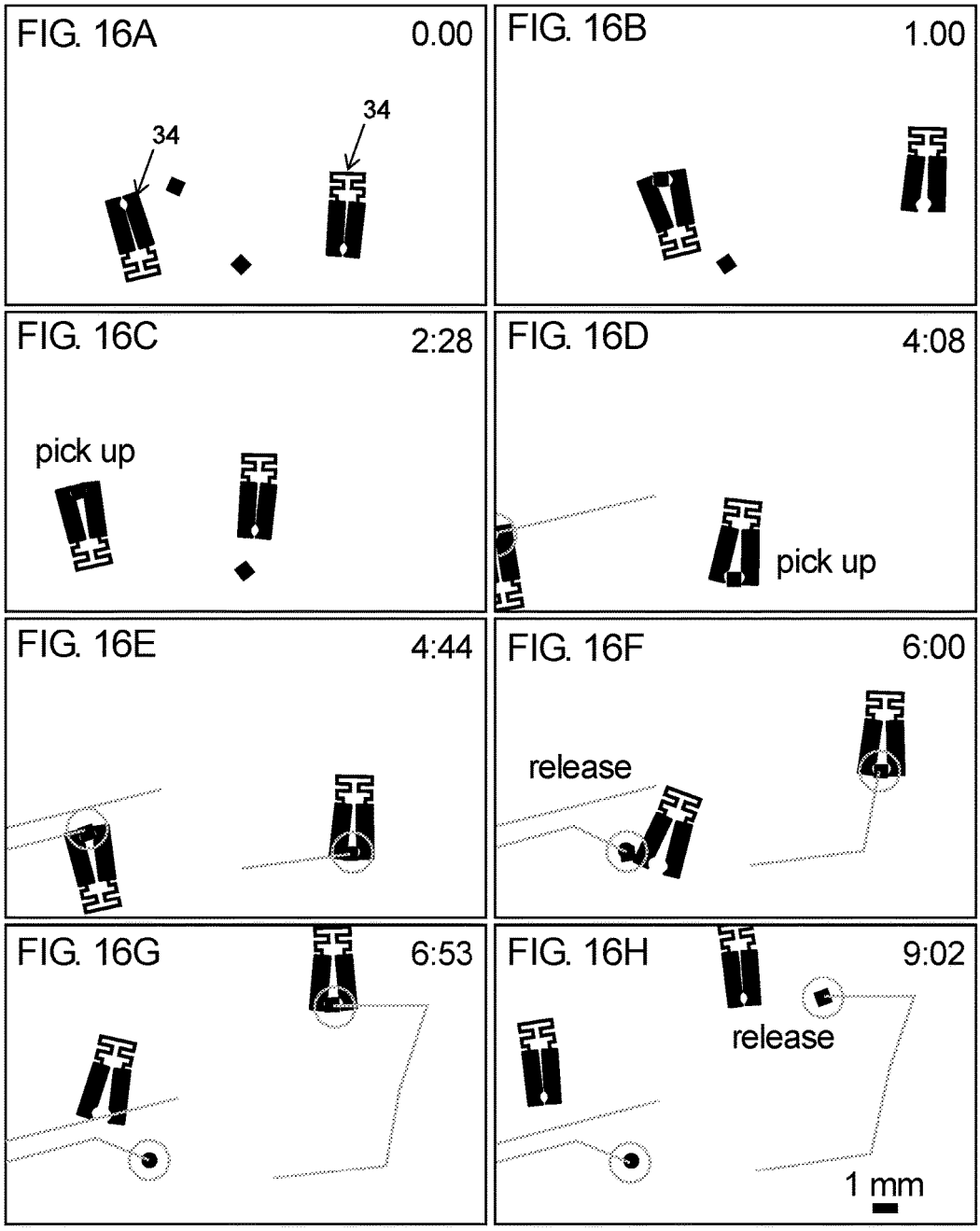
FIGS. 16A-16H illustrate parallel operation of two addressable mobile micro-grippers.

The part began lying prone on the substrate. Assembly required grasping the part, orienting it to the out-of-plane configuration and placing it in the hole. The part can be assembled into any hole location on the patterned substrate for programmable actuation. During assembly, the part is in a non-magnetized state. Once assembly is complete, as in FIG. 15*d*, a short magnetic pulse magnetizes the part for actuation. Then the part can be rotated in-plane by an applied magnetic field, as shown in FIG. 15*e*. The rotation rate of the 'T' is in synchrony with the applied field, as shown in FIG. 15*f*. The rotation induces a rotational fluid flow around the assembled part, which manipulates 200 μm microspheres placed in the liquid, similar to our previous work on non-contact manipulation.

Shown in FIGS. 15*h-q* is the assembly of a functional four-bar mechanism in an out-of-plane 3D configuration. This mechanism is made from assembling three links into mating holes in the substrate. These posts have a Y-shaped top to accommodate a connecting rod between them. The rod is assembled in the final step, as in FIG. 15*q*. This assembly task required sequential grasping, orienting and assembly of three objects larger than the size of the gripper itself.

Addressable grasping by a team of force-based micro-grippers can be achieved through control of the open or closed state of each gripper in the set. To open or close a single gripper, it must be brought into a different orientation from the other grippers in the set. This is accomplished in a multi-step process using magnetic field gradients, as detailed in Supplementary Figure S3. The direction of magnetic field pulse is along the axis connecting the two gripper arms, such that the arm magnets are magnetized towards or away from each other for the open or closed configurations, respectively. Any open-closed state of an array of micro-grippers can be achieved if their spacing along a single direction is sufficient.

Frames from a video of two micro-grippers working in parallel to pick, move, and place two polyurethane blocks in 2D are shown in FIGS. 16*a-h*. This demonstration shows the potential for increased throughput of the micro-gripper system. Addressable gripping cannot be achieved with the torque-style gripper design as it does not exhibit latching behavior. With the torque-style gripper, the magnetization direction of both gripper arms must be changed to adjust the gripping mode, which cannot be accomplished with a single field pulse. However, the force-based gripper only requires a single magnet arm to switch magnetization direction, and is thus suited for pulsed addressable actuation.

Using a flexible material with programmed and dynamic component magnetization, the creation of mobile micro-grippers has been shown, which can be actuated by remote magnetic fields. The grippers were moved and oriented in 2D or 3D using low-strength magnetic fields, and opened or closed using large fields applied by a set of magnetic coils. This allowed for precise manipulation and assembly of micro-components in remote or enclosed spaces for the creation of multi-part functional assemblies. The actuation of these assemblies demonstrated that complex 3D materials and mechanisms could be created using single or groups of mobile micro-grippers. This capability could lead to new methods for cargo delivery or the fabrication of metamaterials, active components in microfluidic channels, and desktop micro-factories for creation of advanced materials and structures from heterogeneous building blocks.

Micro-grippers were fabricated using the micromolding process detailed in below (FIGS. 19*a-d*). ST-1087 polyurethane (BJB Enterprises) is chosen for its moderate stiffness and ease of molding. This is mixed with magnetic powders with a polymer to magnet mass ratio of 1:1 for ferrite powder and 2:1 for NdFeB powder. Magnetic powders are ferrite (BaFe12O19, Hoosier Magnetics) and NdFeB (MQP-15-7, Magnequench), refined in a ball mill to a particle size of 5-10 μm.

Micro-cylinders (e.g., micro-part) are made from a nylon wire with a diameter of 300 μm. The wires are cut to length using a razor blade. Micro-objects with square cross-section are molded in a similar process to the micro-grippers, and are made from ST-1087 polyurethane. To make an object capable of magnetic activation, as shown in the demonstrations of FIG. 14, ferrite particles are included with a mass ratio of 1:1 ferrite to polyurethane. To allow for ease of manipulation in the demonstrations, a 500 μm long nylon wire segment was fixed to the polyurethane object with UV-curable adhesive.

Magnetic fields are supplied by a set of eight magnetic coils arranged pointing to a common center point. The electromagnetic coil currents are controlled using a PC with data acquisition system using linear electronic amplifiers (Dimension Engineering Inc., SyRen 25) with feedback from Hall-effect current sensors (Allegro Microsystems Inc., ACS714). The workspace is observed by a CCD camera (Foculus). The high strength field pulse is delivered by a 20-turn, low-inductance (8 pH) coil of inner diameter 23 mm, placed within the larger coil set. The pulsing coil is driven by a 0.8 mF electrolytic capacitor bank in a series LCR circuit, triggered by a silicon-controlled rectifier (SCR, Vishay, VS-70TPS12). The pulse strength is proportional to the capacitor charging voltage, and is applied manually using a switch to trigger the SCR.

In summary, FIGS. 16*a-h* illustrate parallel operation of two addressable mobile micro-grippers: (a) Two identical micro-grippers start in the closed configuration, with two polyurethane disks nearby; (b) The first micro-gripper approaches a disk; (c) The first gripper is closed over the disk, grasping it; (d) The second micro-gripper is positioned over the second disk, while the first gripper retains its cargo; (e) Both micro-grippers have grasped their cargo and carry it in parallel to the desired location; (f) The first gripper releases its cargo; (g) The second gripper moves to its goal position; (h) The second gripper releases its cargo. Time indicated on each pane is minutes:seconds.

Figure 17:
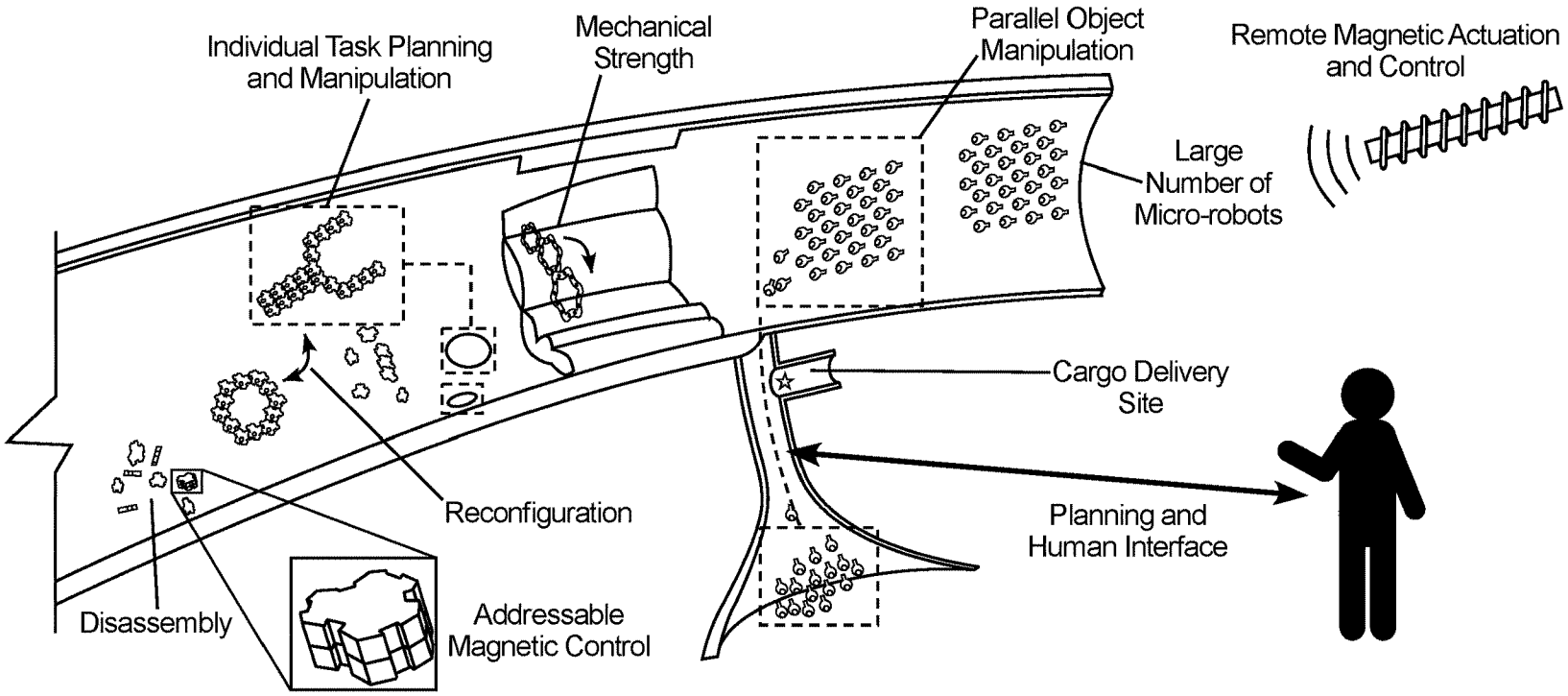
FIG. 17 illustrates another remote magnetic switching embodiment of the present invention.
Figure 18A:
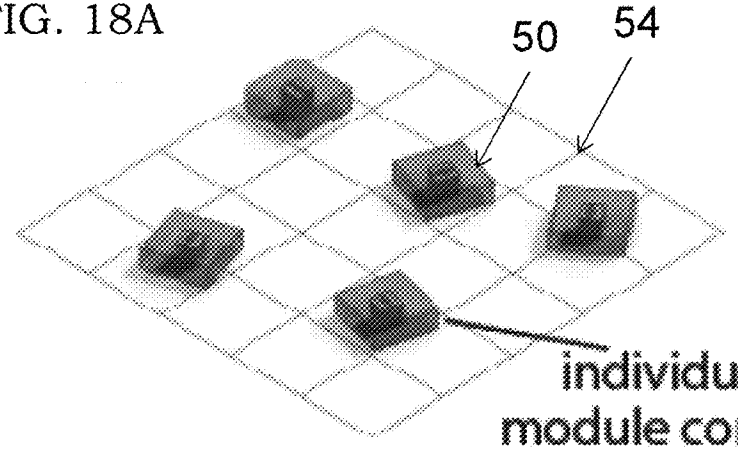
FIGS. 18A-18D illustrate another application of the reconfigurable micro-module concept of the present invention.
Figure 18B:
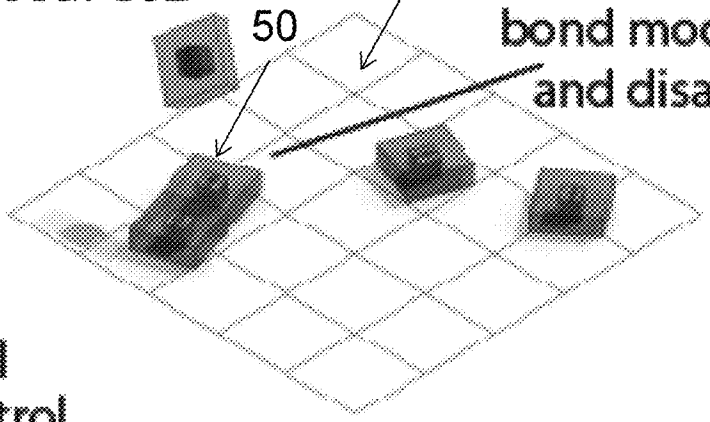
Figure 18C:
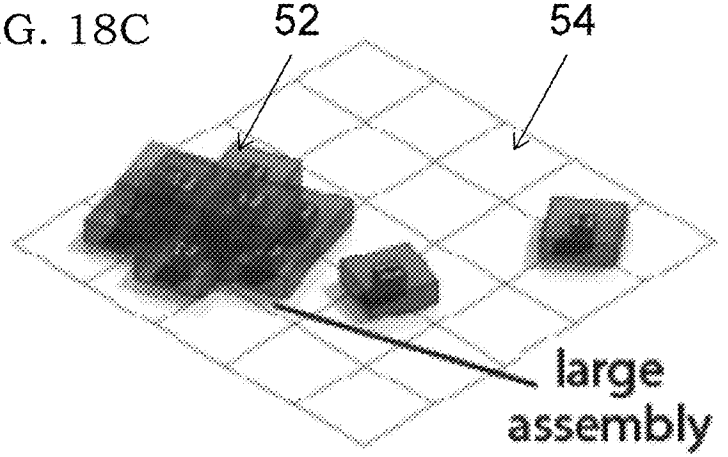
Figure 18D:
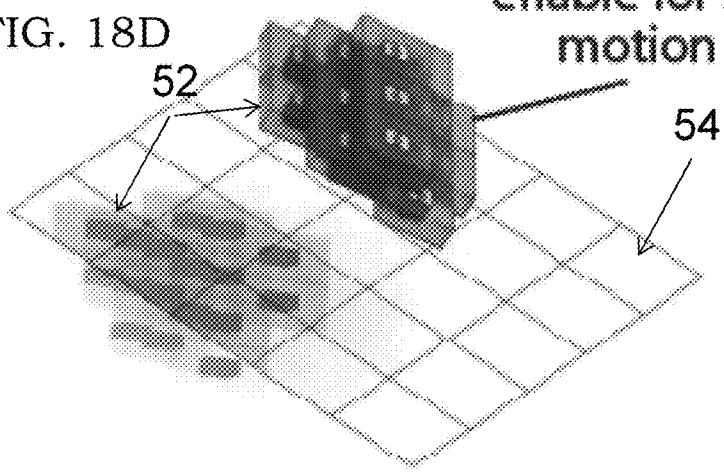

Now turning to FIG. 17 illustrating another remote magnetic switching embodiment of the present invention used to address and control a large number of composite magnetic micro-modules inside the human body or in a microfluidic channel or another confined or enclosed space for medical, manufacturing, biotechnology, and other applications. Here, groups of individually-addressed magnetic microrobots are shown accessing remote small spaces to accomplish goal tasks in parallel. The microrobots are controlled in 3D to accomplish tasks of manipulation, payload delivery and assembly/reconfiguration to create novel microtools never seen before. The microrobot workspace is contained in a large magnetic coil system which provides power and signals remotely to the microrobots. The system is controlled using visual feedback, allowing for sophisticated feedback control. Microrobot teams are assigned high-level tasks by a human user via a computer terminal, while low-level motion planning and control will be performed autonomously by computer algorithms. Refer to FIGS. 8*a-f*, FIGS. 12*a-d*, and FIGS. 16*a-h* and their accompanying description herein for a detailed description of the operation of the microrobots.

Now turning to FIG. 18(*a-d*) that illustrate another application of the reconfigurable micro-module concept of the present invention. The magnetic disabling addressing invention proposed here can be used as a new versatile addressing method for reconfigurable magnetic micro-module assemblies, allowing for the creation of large assemblies in an arbitrary environment. In this manner, as shown in FIG. 18(*a-d*), reconfigurable modules 50 can be introduced one at a time, bonded to the assembly and disabled. Thus, during assembly, the assembly itself can be magnetically inert. Once the final module 50 is added to the assembly 52, the entire assembly 52 can be re-enabled, to allow for magnetically actuated motion in 2D and 3D. This serial assembly method can allow for large assemblies to be created for high-resolution 2D and 3D shapes. FIG. 18(*a-d*) illustrate that micro-robots capable of being addressed by magnetic disabling, allowing for much larger assemblies and operation in any environment in 3D. FIG. 18(*a*) illustrate that all micro-robots 50 begin on the substrate 54, where they are capable of independent locomotion (see discussed above). FIG. 18(*b*) illustrates that the micro-robots 50 begin to assemble and are bonded together. Each module 50 is disabled after assembly. FIG. 18(*c-d*) illustrate the completed assembly 52 enabled and released from the substrate 54 where it can be actuated in 3D.

Gripper Fabrication

Now turning to FIGS. 19*a-i* for a representation of a micro-gripper fabrication process of the present invention. The full microfabrication process for mobile micro-gripper parts is shown in FIG. 19 *a-d*. This process allows for multiple permanent magnetic materials to be included in one micro-gripper design. The process steps include photoresist deposition and patterning, mold creation, and part molding: FIG. 19(*a*) SU-8 photoresist is spun onto a silicon wafer; FIG. 19(*b*) By photolithography, the SU-8 is patterned into the extruded 2D shapes of the grippers; FIG. 19(*c*) A rubber mold is cast over the SU-8 positive features; FIG. 19(*d*) A magnetic slurry consisting of magnetic microparticles and polymer binding matrix is poured into the negative mold, degassed in vacuum and scraped level using a razor blade.

Demolded shapes created are shown in FIG. 19 *e-i* for torque- and force-based designs with different flexure geometries. Flexures are designed to have similar stiffness values. FIG. 19(*e*) and FIG. 19(*f*) show torque-based designs, while FIG. 19 *g-i* show force-based designs. FIG. 19(*e-i*) illustrate micro-gripper shapes pulled from the mold using tweezers. Micro-gripper designs, with CAD model on the left and fabricated polymer-based flexible designs on the right. FIG. 19(*e-f*) illustrate Torque-based designs, showing simple and meander flexure design. Each design has approximately the same flexure stiffness. The mobility magnet is seen on the left side of the design. FIG. 19(*g-i*) illustrate Force-based designs, showing simple and meander flexure design. Each design has approximately the same flexure stiffness.

Gripper Deflection Analysis

Figure 19A:
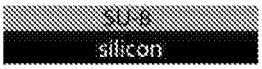
FIGS. 19A-19I represent a micro-gripper fabrication process of the present invention and exemplary micro-grippers mad from the fabrication process.
Figure 19B:
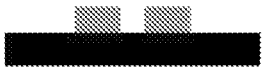
Figure 19C:
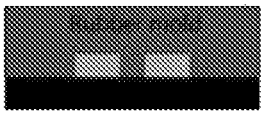
Figure 19D:
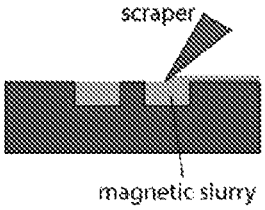
Figure 19E:
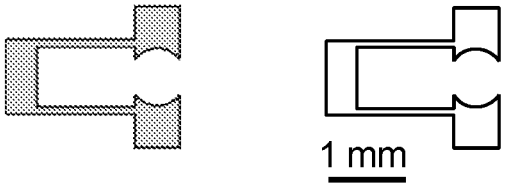
Figure 19F:
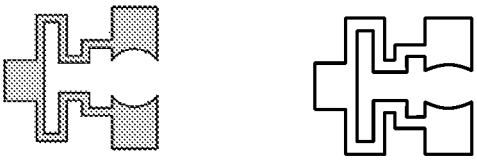

Torque-based micro-grippers. Assuming a straight flexure design, as shown in FIG. 19*e* with arm thickness t (in-plane), width w and length L, the deflection δ of the gripper tip under a magnetic torque of T is given as $$\delta = \frac{TL^2}{2EI}, \tag{7}$$

where E is the elastic modulus and $$I = \frac{tw^2}{12}$$

is the area moment of inertia of the rectangular arm cross-section. The magnetic torque is proportional to the field strength B and the gripper tip magnetic moment m and the sine of the angle between the moment and the applied field. Assuming that the field is applied perpendicular to the gripper magnetization directions as shown in FIG. 13*b*, the magnetic torque is $T=\mu_0 mH$, where $\mu_0=4\pi\times10^{-7}$ H/m is the permeability of free space. Thus, through substitution the gripper deflection can be found as $$\delta = \frac{\mu_0 6mHL^2}{Etw^3}. \tag{8}$$

These equations have assumed small deflections and a simple flexure design, as well as no magnetic interaction between the magnetic elements in the micro-gripper. More complex designs, shown in FIGS. 19*f-i*, include meandering spring designs to achieve a more compact gripper design, and cannot be analyzed in such a simple manner. These designs can be analyzed by finite element analysis (FEA) or through meandering spring approximations.

Figure 19G:
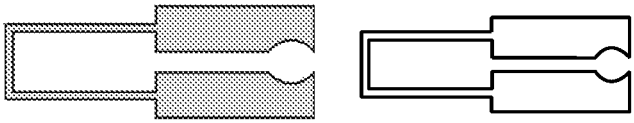
Figure 19H:
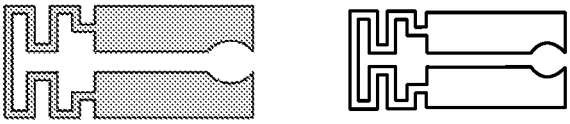
Figure 19I:
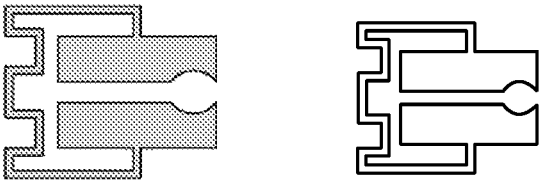

Force-based micro-grippers. Assuming a straight flexure design, as shown in FIG. 19*g* with arm thickness t (in-plane), width w and length L, the deflection δ of the gripper tip under a magnetic attractive force of F is given as $$\delta = \frac{FL^3}{3EI}. \tag{9}$$

The magnetic attractive force depends strongly on the gripper tip center-to-center spacing z, and for magnetizations parallel or antiparallel and coaxially aligned, as shown in FIGS. 13*b* and 13*e*, is given as $$F = \frac{\mu_0 m^2}{2\pi z^4}.$$

This model assumes that the magnetic mass is modeled as a magnetic dipole centered at the magnet center of mass, which may lose accuracy for very close spacing. For parallel/antiparallel magnetizations, which are 'next to' each other rather than coaxially aligned, the magnetic attraction/repulsion will be half this value. Thus, the coaxially aligned configuration is used.

The gripper deflection can be found as $$\delta = \frac{\mu_0 m^2 L^3}{2\pi Etw^3 z^4}. \tag{10}$$

Gripper deflection is measured experimentally by observing the gripper tips in a microscope camera and manually measuring the distance.

Magnetic pulse generation for remote magnetic switching

Figure 20:
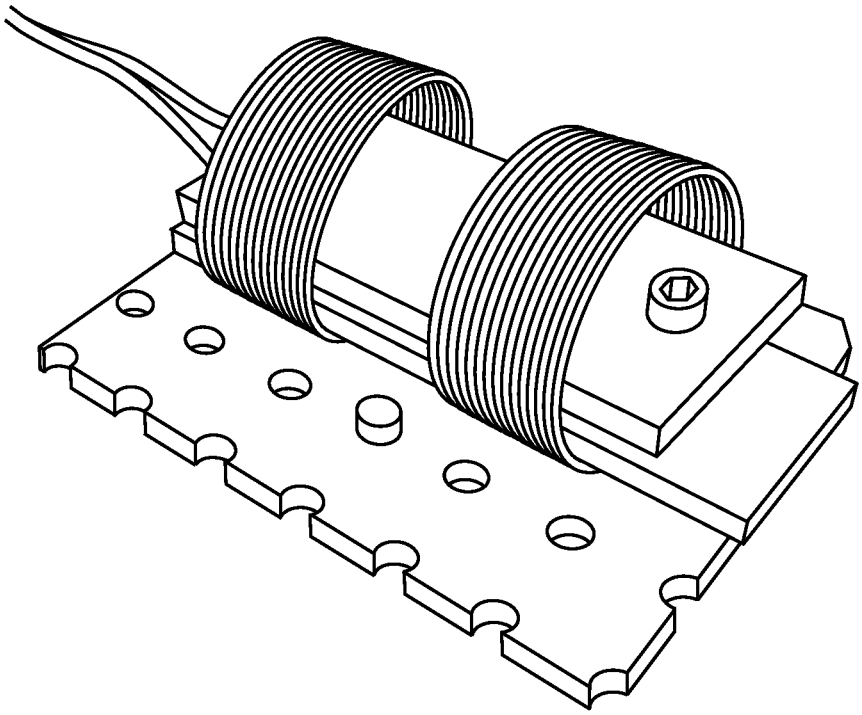
FIG. 20 is a magnetic coil pair used for magnetic pulse generation to actuate the present invention.

The magnetic coils used to generate the short magnetic field pulses are a 20-turn, low-inductance (8 mH) coil of inner diameter 23 mm, placed inside the larger motion actuation coils as shown in FIG. 20. This coil set is placed within the larger coils used to generate the low- and moderate-strength fields. Short pulses are required to remagnetize the ferrite magnetic elements of the force-based grippers before they reorient. A pulse which rises too slowly will fail due to the gripper reorienting to align with the pulse. FIG. 20 is a magnetic coil pair used for magnetic pulse generation to actuate the present invention. The pair forms a 20-turn, low-inductance (8 mH) coil of inner diameter 23 mm. The gap between the coils allows for observation of the workspace, which is placed at the center of the coil pair.

Although the invention is illustrated and described herein with reference to specific embodiments, the invention is not intended to be limit to the details shown. Rather, various modifications may be made in the details without departing from the invention. Those skilled in the art will recognize that the present invention could be used in a variety of applications, including but not limited to cell sorting, cell manipulation, cell transport, milli/microscale biological or non-biological object manipulation and assembly, microfluidic local flow control, lab-on-a-chip device applications, miniature mechanism actuation with single or more degrees of freedom, cell laden micro-gel or other building block manipulation and assembly for bioengineering, assembly of parts from few nanometer scale up to few centimeter scale in two- or three-dimensions in air, liquid or vacuum, medical device (such as catheters, stents, implantable or semi-implantable sensors, hearing aid sensors or devices, eye visual aid sensors or devices, drug delivery devices, capsule endoscopes, laparoscopic tools or devices, surgical tools or devices, diagnostic medical tools or devices, assembling or reconfigurable modules, anchoring tools or devices, medical robots, deep brain stimulation electrodes, neural recording electrodes, and flexible endoscopes) actuation inside or outside the human or animal body, etc. While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. An micro-pump comprising:

a composite comprising two magnetic materials bound in a non-ferromagnetic matrix, wherein at least one magnetic material of the two magnetic materials has a nonzero magnetic coercivity characteristic;

wherein a first magnetic material of the two magnetic materials has a first magnetic material coercivity field, a first magnetic material magnetization moment, and a first magnetic material magnetization direction; wherein the first magnetic material magnetization direction switches in the presence of a first applied field greater than the first magnetic material coercivity field, wherein a second magnetic material of the two magnetic materials has a second magnetic material coercivity field, a second magnetic material magnetization moment, and a second magnetic material magnetization direction; wherein the second magnetic material magnetization direction switches in the presence of a second applied field greater than the second magnetic material coercivity field, and at least one projection extending from the composite.

2. The micro-pump of claim 1, further comprising:

a cavity, wherein the composite is recessed within the cavity, and a channel connected to the cavity, wherein the at least one projection extends into the channel for moving fluid within the channel as the composite rotates.

* * * * *